US006983117B2

(12) United States Patent
Sohmiya et al.

(10) Patent No.: US 6,983,117 B2
(45) Date of Patent: Jan. 3, 2006

(54) IMAGE FORMING APPARATUS CONFIGURED FOR DOUBLE SIDED PRINTING

(75) Inventors: Norimasa Sohmiya, Saitama (JP); Koji Suzuki, Kanagawa (JP); Hideaki Mochimaru, Kanagawa (JP); Naoki Iwata, Saitama (JP); Kunihiko Tomita, Kanagawa (JP); Hiroshi Yokoyama, Kanagawa (JP); Shigeru Watanabe, Kanagawa (JP); Chiemi Kaneko, Ibaraki (JP); Yasukuni Omata, Kanagawa (JP); Hisao Murayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/645,614

(22) Filed: Aug. 22, 2003

(65) Prior Publication Data

US 2004/0101332 A1 May 27, 2004

(30) Foreign Application Priority Data

Aug. 23, 2002 (JP) ..... 2002-243797
Aug. 29, 2002 (JP) ..... 2002-250136

(51) Int. Cl.
*G03G 15/16* (2006.01)
*G03G 15/20* (2006.01)

(52) U.S. Cl. ..... 399/307; 399/302; 399/309

(58) Field of Classification Search ..... 399/306, 399/307, 309, 302, 308, 66, 67
See application file for complete search history.

(56) References Cited

U.S. PATENT DOCUMENTS

| | | | | |
|---|---|---|---|---|
| 4,714,939 | A | 12/1987 | Ahern et al. | 399/309 |
| 5,408,302 | A | 4/1995 | Manzer et al. | 399/306 |
| 6,492,084 | B2 | 12/2002 | Tomita | 430/109.3 |
| 6,505,016 | B2 | 1/2003 | Tomita | 399/67 |
| 6,574,448 | B2 | 6/2003 | Mochimaru et al. | 399/309 |
| 6,584,295 | B2 | 6/2003 | Omata et al. | 399/306 |
| 6,608,985 | B2 | 8/2003 | Mochimaru et al. | 399/309 |
| 6,633,733 | B2 | 10/2003 | Mochimaru et al. | 399/45 |
| 6,643,489 | B2 | 11/2003 | Omata et al. | 399/309 |
| 2001/0051057 | A1 * | 12/2001 | Tomita | 399/67 |
| 2002/0090236 | A1 * | 7/2002 | Omata et al. | 399/309 |
| 2002/0159801 | A1 * | 10/2002 | Nakashima et al. | 399/307 |
| 2003/0035665 | A1 * | 2/2003 | Sakamoto | 399/309 |
| 2003/0235442 | A1 * | 12/2003 | Suzuki et al. | 399/309 |

FOREIGN PATENT DOCUMENTS

| | | |
|---|---|---|
| EP | 1 215 544 | 6/2002 |
| JP | 2002-04821 A * | 2/2002 |

OTHER PUBLICATIONS

Patent Abstracts of Japan, JP 2000-250272, Sep. 14, 2000.

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus of the present invention includes a first and a second intermediate image transfer belt contacting each other to form a nip for secondary image transfer. While the nip is heated, a sheet is passed through the nip to thereby transfer toner images respectively formed on the first and second belts to opposite surfaces of the sheet at the same time. The nip is sized such that image transfer and fixation can be effected at temperature higher than the melting point or the softening point of toner by 5° C. to 50° C.

55 Claims, 18 Drawing Sheets

IMAGE FORMING APPARATUS CONFIGURED FOR DOUBLE SIDED PRINTING

BACKGROUND OF THE INVENTION

1. Field of the Invention

The present invention relates to a thermal image transferring device for thermally transferring toner images to both surfaces of a single recording medium and an image forming apparatus including the same.

2. Description of the Background Art

A printer, copier, facsimile apparatus or similar image forming apparatus of the type effecting the following image forming process is conventional. First, a photoconductive drum or similar image carrier is scanned imagewise to form a latent image thereon. Toner, charged to negative polarity or positive polarity, is deposited on the latent image to thereby produce a corresponding toner image. Subsequently, the toner image is transferred from the image carrier to a sheet or similar recording medium either directly or indirectly via an intermediate image transfer body and then fixed on the sheet by a thermal fixing device. An image forming apparatus of the type described must be provided with implementations that meet the increasing demand for high image forming speed.

For example, a switchback system and a one-pass system are known as systems capable of forming images on both sides of a single sheet. The switchback system forms an image on one surface of a sheet by conveying it via image transferring means and fixing means, turns the sheet, and then switches back the sheet toward the image transferring means and fixing means to thereby form an image on the other surface of the sheet. The one-pass system forms images on both surfaces of a sheet at the same time by conveying the sheet only one time.

More specifically, in a specific configuration of the one-pass system, a first toner image to be transferred to a first surface of a sheet is formed on a latent image carrier and then transferred to an intermediate image transfer body. Subsequently, a second toner image is formed on the latent image carrier. The second toner image and the first toner image carried on the intermediate image transfer body are simultaneously transferred to both surfaces of a single sheet conveyed to a nip between the latent image carrier and the intermediate image transfer body. The sheet is then conveyed to a thermal fixing device to have the toner images fixed thereon.

The one-pass system is free from various problems particular to the switchback system, e.g., high cost ascribable to a sophisticated switchback mechanism, long image forming time ascribable to switchback, and jam ascribable to the switchback of a sheet curled at the fixing means due to heat.

On the other hand, an electrostatic image transfer system and a thermal, simultaneous image transfer and fixation system are known in the art as systems for transferring a toner image from a photoconductive drum or similar image carrier or an intermediate image transfer body to a sheet. The electrostatic image transfer system effects image transfer by forming an electric field at a nip where the image carrier or the intermediate image transfer body, i.e., a donar and a sheet or acceptor contact each other. The thermal, simultaneous image transfer and fixation system heats a toner image carried on the donar to thereby soften it while causing the donar and a sheet to contact each other, and then separate the donar and sheet to thereby transfer the toner image to the sheet and fix the toner image. The thermal, simultaneous image transfer and fixation system is advantageous over the electrostatic image transfer system in that it obviates image degradation ascribable to toner scattering.

More specifically, the problem with the electrostatic image transfer system is that it is extremely difficult to cause the electric field to act only on the nip, i.e., the electric field extends to positions before and after the nip where the donar and sheet are spaced from each other. Toner or similar image forming agent, subject to the above electric field before and after the nip, flies from the donar and deposits on unexpected portions of the sheet. Such toner scattering causes black spots to appear around the resulting toner image or blurs the edges of the toner image.

Japanese Patent Laid-Open Publication No. 2000-250272, for example, discloses an image forming apparatus implementing both of the one-pass system and thermal, simultaneous image transfer and fixation system. This image forming apparatus includes a first and a second belt contacting each other while moving in the same direction (forward direction hereinafter) at a position where they contact each other.

More specifically, in the image forming apparatus taught in the above document, a first toner image formed on a photoconductive drum or image carrier is transferred to the first belt, which is moving in the forward direction in contact with the second belt. At the contact position, a heat roller for heating the first belt while supporting it and a press roller for heating the second belt while supporting it are positioned. The first toner image, electrostatically transferred from the drum to the first belt, is heated at the contact position to be thereby transferred to the second belt.

About the time when the above image transfer is effected, a second toner image is formed on the drum, electrostatically transferred to the first belt, conveyed to the contact position, and then brought into contact with one surface of a sheet. At this instant, the first toner image carried on the second belt is again conveyed to the contact position and brought into contact with the other surface of the sheet. The first and second toner images both are heated at the contact position to be thereby transferred to opposite surfaces of the sheet and fixed thereon.

Thus, the above image forming apparatus achieves the merits of both of the one-pass system and thermal, simultaneous image transfer and fixation system. Further, the apparatus does not directly heat the drum and therefore protects it from damage ascribable to temperature elevation while obviating image degradation.

However, the conventional image forming apparatus described above has the following problems left unsolved, Because the sheet, nipped between the first and second belts, must be heated from the inner surfaces of the belts, wasteful energy consumption ascribable to heat loss is critical. More specifically, when the fixation of a toner image on a sheet is effected independently of image transfer, it is a common practice to directly heat the sheet with a heat roller or similar heating means, efficiently transferring heat from the heating means to the sheet.

By contrast, in the thermal image transfer and fixation system that cannot directly heat a sheet, it is necessary to transfer the heat of the heat roller, pressure roller or similar heating means contacting the inner surface of the first or the second belt to the sheet indirectly via the belt. As a result, heat is stored in the first and second belts. Heat stored in the first and second belts is wastefully radiated because the first and second belts each move with both surfaces thereof being exposed to space. Moreover, the first belt must be intentionally cooled off by cooling means in order to obviate image degradation ascribable to the temperature elevation of the image carrier, as needed. These, in combination, noticeably increase wasteful energy consumption ascribable to energy loss.

The wasteful energy consumption stated above is more aggravated as a period of time over which the sheet and belt contact each other at the contact position is reduced. More specifically, when a sheet is indirectly heated via the belt, the outer surface of the belt is cooled due to heat transfer to the sheet despite that the inner surface is heated by the heating means. As a result, a temperature gradient occurs on opposite surfaces of the belt.

To heat a toner image to its melting point or softening point against the temperature gradient mentioned above, the heating temperature of the heating means must be made higher than the melting point or the softening point. For example, to heat a toner image at the contact position to 120° C., which is the softening point, the heating means must heat the belt to 140° C. higher than the softening point by 20° C. from the inner surface of the belt. At this instant, assume that the outer surface of part of the belt just preceding the contact position is 125° C., and that the outer surface of the belt and sheet contact each other for 0.5 second. Also, assume that it is desired to vary the contact time to 0.25 second, which is one-half of the above period of time, for heating the toner image to 120° C.

To implement the above temperature elevation, the same amount of heat as before the variation must be applied to the sheet and therefore toner image via the belt in one-half of the contact time, so that the temperature of the surface of the belt, starting contacting the sheet, must be raised. For example, it is necessary to raise the heating temperature of the heating means to 170° C. by 30° C. for thereby raising the temperature of the above belt surface to 135° C. higher than 125° C.

With the above scheme, it is possible to substantially double the amount of heat to be transferred to the sheet for a unit time, i.e., apply the same amount of heat as before the contact time is halved to the sheet. Despite that the contact time is halved, the temperature drop of the belt remains substantially the same because the amount of heat transferred from the belt to the sheet is the same. Consequently, the temperature of part of the belt moved away from the contact position is higher than before the variation. For example, when the contact time is 0.5 second or 0.25 second, the temperature of the above part of the belt is 120° C. or 130° C., respectively. In any case, the part of the belt moved away from the contact position must be cooled off to the desired level before reaching the image carrier, so that extra cooling is required as the contact time is reduced and aggravates heat loss.

Generally, in an image forming apparatus of the type fixing a toner image on a sheet with heat, heating means for fixation consumes more energy than the other structural parts. In this respect, the wasteful energy consumption ascribable to heat loss described above critically effects running cost and, in the worst case, increases the cost to an impractical degree. In this sense, it is preferable to confine the heating temperature of the heating means in a range higher than the melting point or the softening point of the image forming agent by 5° C. to 50° C.

Another problem with the image forming apparatus using both of the one-pass system and thermal, simultaneous image transfer and fixation system is that the leading edge positions of images formed on opposite surfaces of a sheet are shifted from each other for the following presumable reasons.

Usually, in the one-pass system, the second toner image formed on the first image carrier is transferred to a sheet at the nip between the first and second image carriers. On the other hand, the first toner image on the second image carrier may be transferred to the sheet at the above nip or at a different position on a sheet conveyance path. However, to implement image transfer at a position different from the nip, additional image transferring means for transferring the first toner image to the sheet is essential. Even when the first toner image is transferred at the nip, an arrangement must be made such that the leading edge of the first toner image enters the nip at the same time as the leading edge of the second toner image.

However, when toner is melted by heat as in the thermal image transfer and fixation system, the temperature of the first image carrier and that of the second image carrier rise due to heat applied during image transfer. As a result, the lengths of the endless paths along which the first and second image carriers move each increase in accordance with the temperature elevation and the coefficient of thermal expansion. It a difference in path length between the first and second image carriers varies, but a latent image representative of the second toner image is formed on the image carrier at fixed timing, then the timing at which each toner image enters the nip is shifted.

In the case of the electrostatic image transfer system that does not heat the image carrier during image transfer, the difference in path length between the first and second image carriers varies little. Therefore, only if a latent image representative of the second toner image is formed on the latent image carrier at fixed timing, the leading edges of the first and second toner images are shifted little from each other on the sheet.

Even when toner is melted by heat for transferring the first and second toner images to the sheet at the nip, the leading edge of each toner image is shifted little if the temperature of the image carrier raised during image formation is the same at all times. This is because the extension of the path length of the image carrier ascribable to thermal expansion remains the same during image formation, and therefore the difference in path length between the first and second image carriers does not vary during image formation. Therefore, if a latent image representative of the second toner image is formed at timing selected by taking account of the above extension, the leading edge of the toner image is shifted little as in the electrostatic image transfer system.

In practice, however, the temperature of each image carrier during image formation does not remain constant, depending on the condition in which the apparatus is operated. For example, each image carrier is operated over a longer period of time and more heated in a repeat print mode than in a single print mode. Consequently, the temperature of each image carrier and therefore the difference in path length varies from one mode operation to another mode operation. Particularly, when each image carrier is heated to 100° C. or above due to thermal image transfer, the shift of the leading edge positions is not negligible.

SUMMARY OF THE INVENTION

It is a first object of the present invention to provide a thermal image transferring device capable of confining, while implementing both of the one-pass image transfer system and thermal, simultaneous image transfer and fixation system, the heating temperature of the heating means in the previously stated range, and an image forming apparatus including the same.

It is a second object of the present invention to provide a thermal image transferring device capable of reducing, when toner images are thermally transferred from image carriers to opposite surfaces of a single sheet, a shift of the leading edge positions of the toner images relative to each other, and an image forming apparatus including the same.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
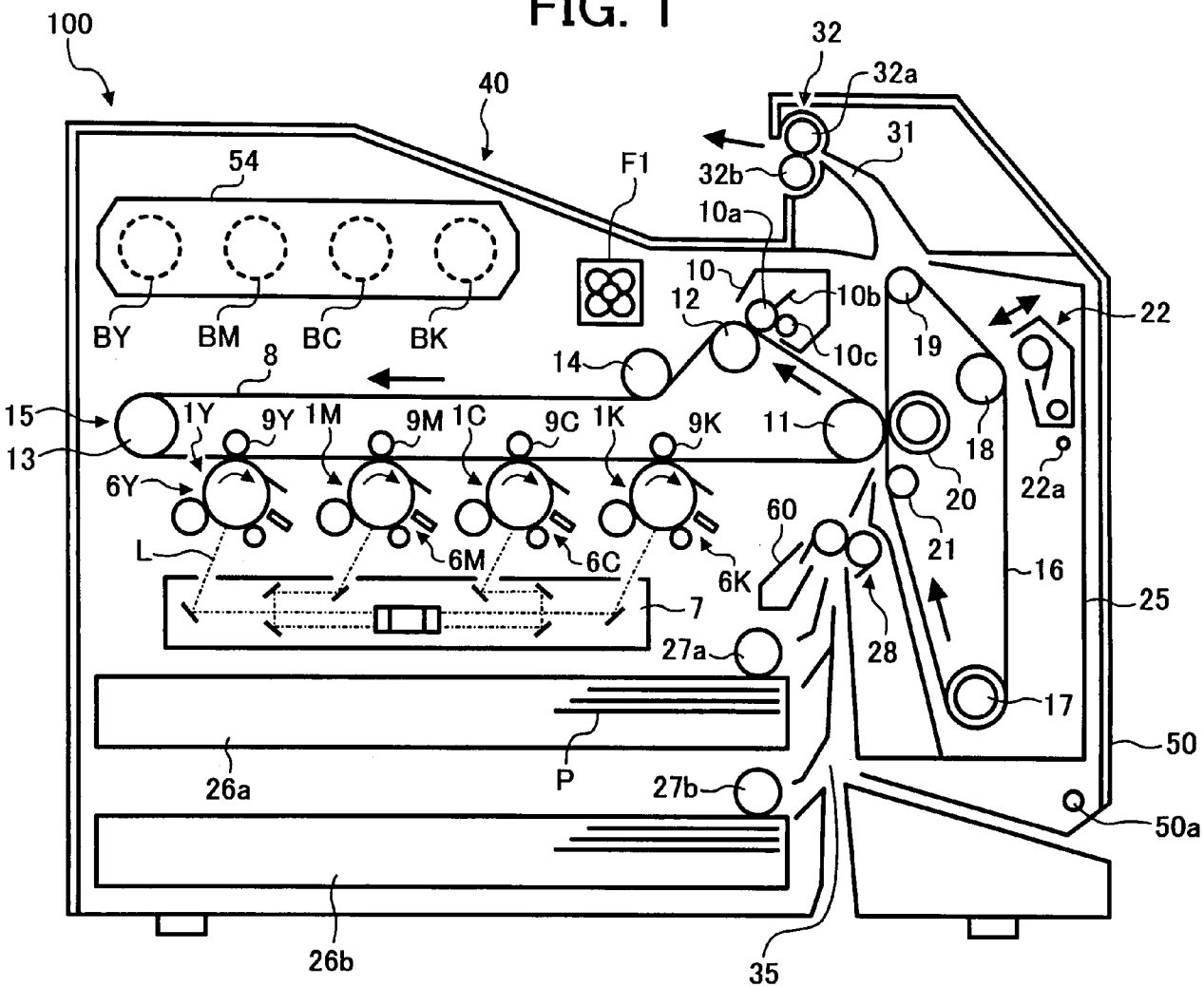
FIG. 1 is a view showing an image forming apparatus embodying the present invention.

Referring to FIG. 1 of the drawings, an image forming apparatus embodying the present invention and implemented as an electrophotographic printer by way of example will be described hereinafter. This embodiment is directed mainly toward the first object stated earlier. As shown, the printer, generally 100, includes four process cartridges 6Y (yellow), 6M (magenta), 6C (cyan) and 6K (black) identical in configuration except for the color of toner stored thereon. The process cartridges 6Y through 6K each are replaced when its life ends.

Figure 2:
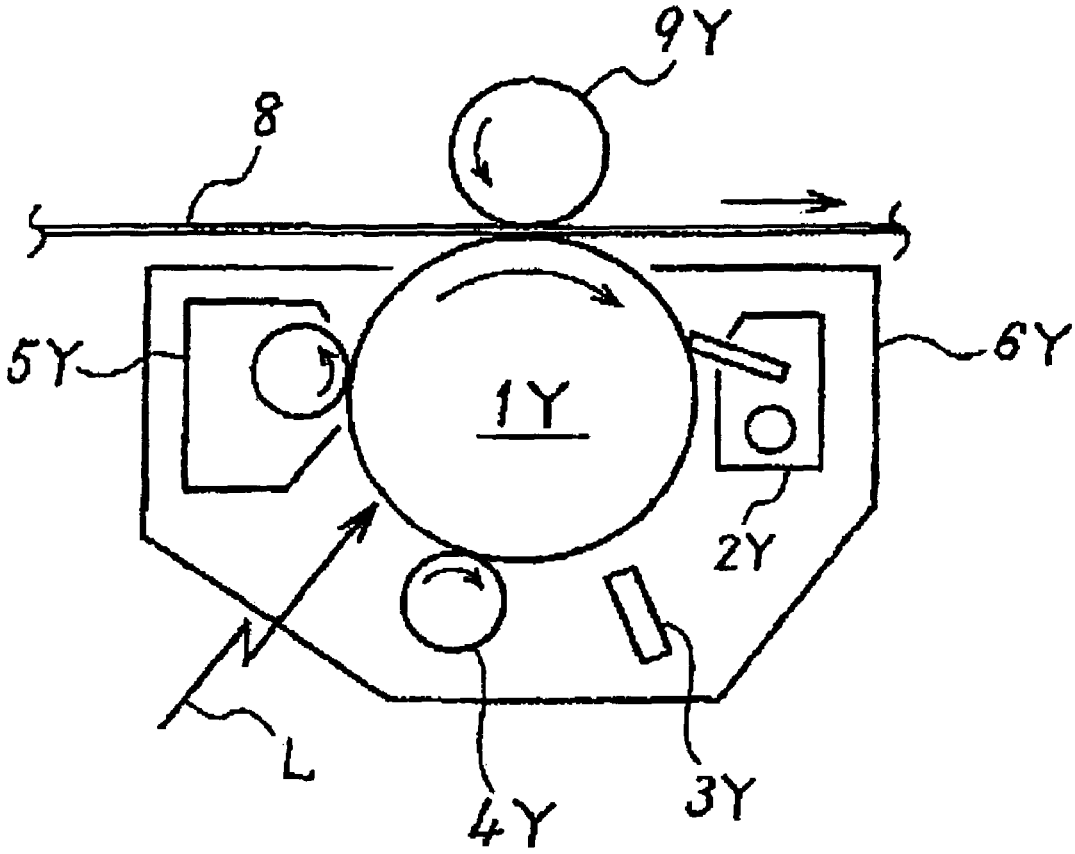
FIG. 2 is a view showing one of process cartridges included in the illustrative embodiment specifically.

FIG. 2 shows the process cartridge 6Y by way of example specifically As shown, the process cartridge 6Y includes a photoconductive drum or image carrier 1Y, a drum cleaner 2Y, a quenching lamp or similar discharger 3Y, a charger 4Y, and a developing device 5Y. The drum 1Y is made up of a hollow cylindrical tube formed of aluminum and provided with a diameter of 30 mm to 100 mm and a surface layer formed of an OPC (Organic PhotoConductor). The surface layer may alternatively be implemented by amorphous silicon, if desired. The drum 1Y may, of course, be replaced with a photoconductive belt.

The charger 4Y uniformly charges the surface of the drum 1Y while being caused to rotate clockwise, as viewed in FIG. 1 by drive means not shown. A laser beam L scans the charged surface of the drum 1Y to thereby form a latent image. The developing device 5Y develops the latent image with yellow toner to be thereby form a yellow toner image. The Y toner image is then transferred from the drum 1Y to a first intermediate image transfer belt 8, which will be described later. This image transfer will be referred to as primary image transfer hereinafter. After the primary image transfer, the drum cleaner 2Y removes toner left on the drum 1Y while the discharger 3Y discharges the surface of the drum 1Y thus cleaned to thereby prepare it for the next image formation.

In the other process cartridges 6M, 6C and 6K, an M, a C and a K toner image are formed on drums 1M, 1C and 1K, respectively, in exactly the same manner as the Y toner image and sequentially transferred to the first intermediate image transfer belt 8 over the Y toner image by primary image transfer. An exposing unit 7 is positioned below the process cartridges 6Y through 6K. In the illustrative embodiment, the process cartridges 6Y through 6K and exposing unit 7 constitute, in combination, toner image forming means for forming toner images on photoconductive elements.

An image data processor, not shown, positioned in the vicinity of the exposing unit 7, generates a scanning control signal in accordance with an image data signal received from, e.g., a personal computer, not shown, and sends the image data signal to the exposing unit 7. The exposing unit, or latent image forming means, 7 scans the drums 1Y through 1K of the process cartridges 6M through 6K with laser beams L in accordance with the scanning control signal. As a result, latent images to be developed by Y toner through K toner are formed on the drums 1Y through 1K, respectively.

The exposing unit 7 includes a light source for issuing the laser beam L, a polygonal mirror rotatable to deflect the laser beam L, and a plurality of lenses and mirrors for focusing the laser beam L thus deflected on each of the drums 1Y through 1K. Such an exposing unit 7 may be replaced with an LED (Light Emitting Diode) array including a plurality of LEDS. A seal member, not shown, is positioned on the casing of the exposing unit 7 for preventing the toners, which drop from the drums 1Y through 1K, from entering the exposing unit 7.

A first and a second sheet cassette 26*a* and 26*b* and pickup rollers 27*a* and 27*b* associated therewith are positioned below the exposing unit 7, as viewed in FIG. 1. The sheet cassettes 26*a* and 26*b* each are loaded with a stack of sheets P while the pickup rollers 27*a* and 27*b* contact the tops of the sheet stacks P of the sheet cassettes 26*a* and 26*b*, respectively. When either one of the pickup rollers 26*a* and 26*b* is caused to rotate counterclockwise, as viewed in FIG. 1, by drive means not shown, the pickup roller 26*a* or 26*b* pays out the top sheet P toward a sheet path 35. The sheet P thus paid out is conveyed to a registration roller pair 28. The registration roller pair 28 nips the leading edge of the speed P and then starts conveying it toward the inlet of a nip for secondary image transfer, which will be described later, at preselected timing.

A registration roller cleaner 60 is held in contact with one of the registration rollers 28 for removing impurities deposited thereon. While the printer 100 is capable of forming a full-color image, as will be described later, impurities deposited on the sheet P are apt to critically disturb the tonality of a full-color image. More specifically, paper dust and a sizing material added to the sheet P during production are deposited on the sheet P and would disturb tonality if fixed together with a toner image. This is why the registration roller cleaner 60 is assigned to one of the registration rollers 28. The registration roller cleaner 60 should preferably be assigned to each of the registration rollers 28. To remove the impurities, the registration roller 28 may be applied with a charge or charged by friction or formed of adhesive rubber by way of example.

A first image transferring unit 15 is positioned above the process cartridges 6Y through 6K and includes the first image transfer belt (first belt hereinafter) 8. The first image transferring unit 15 includes four primary image transfer rollers 9Y through 9K, a first belt cleaner 10 and a tension roller 14 in addition to the first belt 8. The tension roller 14 plays the role of a cooling member or cooling means for cooling the first belt 8 at the same time. The first belt 8 is passed over a first heat roller 11, a first cleaning backup roller 12 and a tension roller 13 and caused to turn counterclockwise, as viewed in FIG. 1, by any one of the rollers 11 through 13. The four primary image transfer rollers 9Y through 9K each form a respective primary image transfer nip between it and corresponding one of the drums 1Y through 1K via the belt 8.

While the primary image transfer rollers 9Y through 9K each apply a bias for image transfer of polarity opposite to the polarity of toner, e.g., a positive bias to the inner surface of the first belt 8, the rollers 9Y through 9K may be replaced with chargers including a discharge electrode each. The first belt 8 is provided with resistance suitable for such primary image transfer. More specifically, the first belt 8 is made up of a 20 $\mu$m to 400 $\mu$m thick base implemented as a resin film or rubber and a surface layer coated on the base and having low surface energy. With this configuration, the first belt 8 has volumetric resistivity of $10^6$ $\Omega\cdot$cm to $10^{14}$ $\Omega\cdot$cm and surface resistivity of $10^5$ $\Omega\cdot cm^2$ to $10^{15}$ $\Omega\cdot cm^2$. The rollers other than the primary image transfer rollers 9Y through 9K all are electrically grounded.

The first belt 8 in movement sequentially passes the Y through K nips for primary image transfer. At the nips for primary image transfer or first image transfer positions, the Y through K toner images formed on the drums 1Y through 1K, respectively, are sequentially transferred to the first belt 8 one above the other, completing a composite four-color toner image. The first belt 8 and a second image transfer belt (simply second belt hereinafter) 16, moving in contact with each other in the same direction, form a secondary image transfer nip therebetween. The four-color toner image is transferred from the first belt 8 to the second belt 16 at the secondary image transfer nip.

The first belt cleaner 10 removes toner left on part of the first belt 8 moved away from the secondary image transfer nip. More specifically, part of the first belt 8, moved away from the secondary image transfer nip, is nipped between the first belt cleaner 10 and the first cleaning backup roller 12, which respectively contact the outer surface and inner surface of the belt 8. The belt cleaner 10 mechanically or electrostatically removes the toner left on the outer surface of the first belt 8.

The first belt cleaner 10 includes a cleaning roller 10*a* for removing toner from the first belt 8 and a blade 10*b* for scraping off the toner from the cleaning roller 10*a*. The toner so collected is conveyed to a toner collecting section not shown. The surface of the cleaning roller 10*a* is made rougher than the surface of the first belt 8, so that a heater, disposed in the cleaning roller 10*a*, can melt the toner on the first belt 8 via the belt 8 for thereby causing the toner to adhere to the roller 10*a*. The cleaning roller 10*a* may be formed of copper or aluminum having high thermal conductivity.

A bottle container 54, disposed above the first image 5 transferring unit 15 as viewed in FIG. 1, contains toner bottles BY, BM, BC and BK for replenishing toners to the developing devices of each of the respective process cartridges 6Y, 6M, 6C, and 6K, such as developing device 5Y shown in FIG. 2. A cooling fan F1 is positioned at the right-hand side of the bottle container 54, as viewed in FIG. 1, in order to drive air inside the printer body to the outside, thereby preventing temperature inside the printer body from elevating.

A secondary image transferring unit 25 is located at the right-hand side of the first image transferring unit 15, as viewed in FIG. 1, and includes the second belt 16 and a second belt cleaner 22. The second belt 16 is passed over a tension roller 17, a second cleaning backup roller 18, a peel roller 19, a second auxiliary heat roller 20 and a second main heat roller 21 and is caused to move clockwise, as viewed in FIG. 1, by any one of the five rollers 17 through 21.

The registration roller pair 28, nipped the leading edge of the sheet P, starts conveying it toward the secondary image transfer nip at such timing that the sheet P contacts the four-color toner image formed on the first belt 8. However, if the four-color toner image is a first toner image to be transferred to a first surface of the sheet P, i.e. , a surface that faces upward when the sheet P is driven out to a stacking section 40, which will be described later, then the registration roller pair 28 does not start conveying the sheet P. In this case, the first toner image is transferred from the first belt 8 to the second belt 16 at the secondary image transfer nip.

On the other hand, if the four-color toner image on the first belt 8 is a second toner image to be transferred to a second surface of the sheet P, i.e., a surface that faces downward on the stacking section 40, then the registration roller pair 28 starts conveying the sheet P at the particular timing mentioned above. In this case, the second toner image is transferred from the first belt 8 to the second surface of the sheet P at the secondary image transfer nip, completing a full-color image including white available with the sheet P. At the same time, the first toner image is transferred from the second belt 16 to the first side of the sheet P (tertiary image transfer hereinafter), completing a full-color image.

The second belt 16 is made up of a 20 $\mu$m to 400 $\mu$m thick base formed of polyimide or polyamide and a surface layer coated on the base and formed of fluorine or similar substance having low surface energy.

Figure 3:
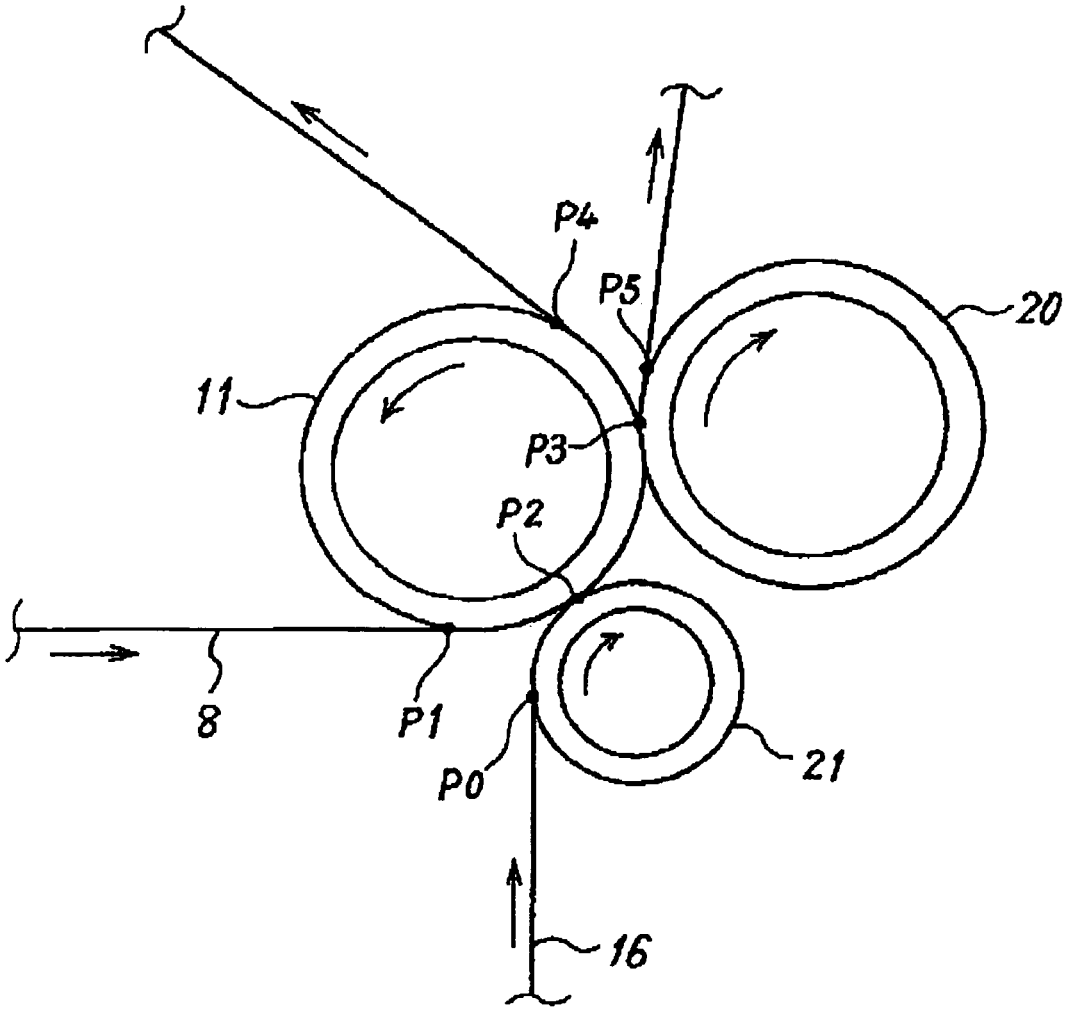
FIG. 3 is a view showing a secondary image transfer nip included in the illustrative embodiment together with members arranged therearound.

FIG. 3 shows the secondary image transfer nip and members arranged therearound in an enlarged scale. As shown, the first heat roller 11, second auxiliary heat roller 20 and second main heat roller 21 each accommodate a respective halogen lamp or similar heating means therein. The first belt 8 is partly passed over the first heat roller 11 while the second belt 16 is passed over the second auxiliary heat roller 20 and second main heat roller 21, which adjoin each other. Part of the first belt 8, passed over the first heat roller 11, is pressed against part of the second belt 16 extending from the second auxiliary heat roller 20 to the second main heat roller 21, as illustrated. In this configuration, the second belt 16 is partly passed over the first heat roller 11 via the first belt 8, contacting the first belt 8 over a large area in the lengthwise direction.

At the secondary image transfer nip, the sheet P is nipped between the first and second belts 8 and 16 moving in the same direction as each other. At this instant, the first heat roller 11 heats the sheet P via the first belt 8 while the second main heat roller 21 and second auxiliary heat roller 20 heat the sheet P via the second belt 16. As a result, the toners, respectively forming the second and first toner images carried on the first and second belts 8 and 16, are heated above the melting point or the softening point thereof and transferred to the second and first surfaces of the sheet P thereby, respectively. Subsequently, the toner images thus transferred to the sheet P are cooled off and fixed on the sheet P.

As stated above, in the illustrative embodiment, the first heat roller 11, second auxiliary heat roller 20 and second main heat roller 21 constitute heating means for heating the secondary image transfer nip or contact position.

Generally, a direction in which a toner image is to be transferred by heat is dependent on a difference in surface condition between two members nipping the toner image therebetween. For example, assume that two members C and D move in the same direction in contact with each other and heated while nipping a toner image therebetween. Then, the toner image, softened by heat, is transferred to the members C or D having greater surface roughness than the other when the members C and D part from each other. This is because the member C or D, having rougher surface than the other, contacts the toner image over a larger surface area due to undulation and exhibits little parting ability. Consequently, if the member C has greater surface roughness than the member D, then the toner image is transferred to the member C by heat. It is to be noted that the sheet P has surface roughness Rz ranging from about 30 $\mu$m to about 50 $\mu$m.

The first belt 8, which is the doner of the first and second toner images, are required to satisfy the following conditions (a) through (e):

(a) extremely low expansion and contraction ratio ascribable to heat;

(b) resistance (surface resistivity and volumetric resistivity) suitable for the primary image transfer;

(c) ability to retain the four-color toner image transferred by the primary image transfer;

(d) contact angle with toner of about 110°; and (e) surface roughness greater than those of the sheet P and second belt 16.

In the illustrative embodiment, use is made of the following first belt 8 satisfying the above conditions (a) through (e). A 20 $\mu$m to 50 $\mu$m thick seamless polyimide belt has a 20 $\mu$m to 30 $\mu$m thick PFA tube adhered to the outer surface of the belt loop as a surface layer. The PFA tube has surface roughness Rz ranging from 1 $\mu$m to 4 $\mu$m.

The second belt 16, which is the acceptor to receive the four-color toner image from the first belt 8 and the doner to give the four-color toner image to the sheet P, is required to satisfy the following conditions (a) and (b):

(a) contact angle with the four-color toner image of about 90°; and (b) surface roughness greater than that of the first belt 8, but smaller than that of the sheet P.

In the illustrative embodiment, use is made of the second belt 16 satisfying the above conditions (a) and (b). A 20 $\mu$m to 50 $\mu$m thick seamless polyimide belt has a 20 $\mu$m to 100 $\mu$m thick surface layer, which contains ETFE, adhered to the outer surface of the belt loop. The surface layer has surface roughness Rz of 5 $\mu$m to 10 $\mu$m.

The first heat roller 11, second auxiliary heat roller 20 and second main heat roller 21 each have its surface temperature sensed by respective temperature sensing means. The surface temperatures so sensed are sent to a controller not shown, The controller ON/OFF controls, in accordance with the sensed surface temperatures, each of the heating means of the rollers 11, 20 and 21, so as to confine the surface temperatures in a preselected target range.

At the outlet of the secondary image transfer nip, the second belt 16 moves in substantially the same direction as before while the first belt 8 sharply bends in accordance with the curvature of the first heat roller 11 at an angle close to a right angle and therefore parts from the sheet P. Consequently, the second belt 16 conveys the sheet P, which carries the toner images on both surfaces thereof, upward, as viewed in FIG. 3, while retaining the sheet P.

As shown in FIG. 1, part of the second belt 16 between the second auxiliary heat roller 20 and the peel roller 19 linearly moves toward the peel roller 19 and then starts moving in substantially in the opposite direction in accordance with the curvature of the peel roller 19. As a result, the sheet P, being conveyed by the second belt 16, is peeled off from the second belt 16 and introduced into an outlet path 31. An outlet roller pair or sheet discharging means, positioned on the outlet path 31 and made up of outlet rollers 32*a* and 32*b*, discharges the sheet P to the stacking section 40 positioned on the top of the printer body.

Part of the second belt 16 from which the sheet P is removed is nipped between the second cleaning backup roller 18 and the second belt cleaner 22 and has the toner left thereon mechanically or electrostatically removed thereby. The toner collected by the second belt cleaner 22 is conveyed by, e.g., a screw to a waste toner container not shown.

Should the second belt cleaner 22 be constantly held in contact with the outer surface of the second belt 16, the second belt cleaner 22 would the first toner image transferred to the belt 16 also. In light of this, a moving mechanism, not shown, selectively moves the second belt cleaner 22 about a shaft 22*a* into or out of contact with the second belt 16. More specifically, at least when the first toner images passes the cleaning position, the above mechanism releases the second belt cleaner 22 from the second belt 16.

Apart from the tandem image forming system shown and described, there is available an image forming system that repeats a sequence of transferring a toner image from a single image carrier to an intermediate image transfer body, forming another toner image on the image carrier, and then transferring the toner image to the intermediate image transfer body over the previous toner image. While this image forming system must repeat the formation of a toner image and transfer of the same, the tandem image forming system is capable of forming toner images on a plurality of image carriers almost at the same time and therefore noticeably increasing image forming speed.

The first image, formed before the second image, is transferred from the first belt 8 to the first surface of the sheet P by way of the second belt 16. The first surface of the sheet P faces upward on the stacking section 40, as stated earlier. The sheet P is stacked on the stacking section 40 with the first toner image facing upward and the second toner image formed after the first toner image facing downward. In this manner, to stack consecutive sheets in incrementing order as to the order of page, one of an odd and an even page larger in page number is formed first as the first toner image. For example, the image of the second page is formed as the first toner image before the image of the first page. This allows images representative of several pages of documents to be sequentially stacked on the stacking section 40 in order or page. However, in a simplex print mode that forms an image only on the second surface of the sheet P, images are formed in incrementing order as to page number and transferred to the second surfaces of the consecutive sheets P, so that the page number increases from the bottom to the top on the stacking section 40.

The second toner image formed on each of the four drums 1Y through 1K is a non-mirror image. This is because the second toner image becomes a mirror image when subjected to the primary image transfer and then becomes a non-mirror image when subjected to the secondary image transfer. That is, the non-mirror image on the drum is also non-mirror on the second surface of the sheet P. By contrast, the first toner image, which is subjected to the tertiary image transfer after the primary and secondary image transfer, is formed on the drum as a mirror image and therefore becomes a non-mirror image on the first side of the sheet P.

A side cover 50 is hinged to one side of the printer body via a shaft 50*a*. Mounted on the side cover 50 are one of the outlet rollers 32, secondary image transferring unit 25, one of the registration rollers 28, the vertical segment of the sheet path 35, and the vertical segment of the sheet path 31.

Figure 4:
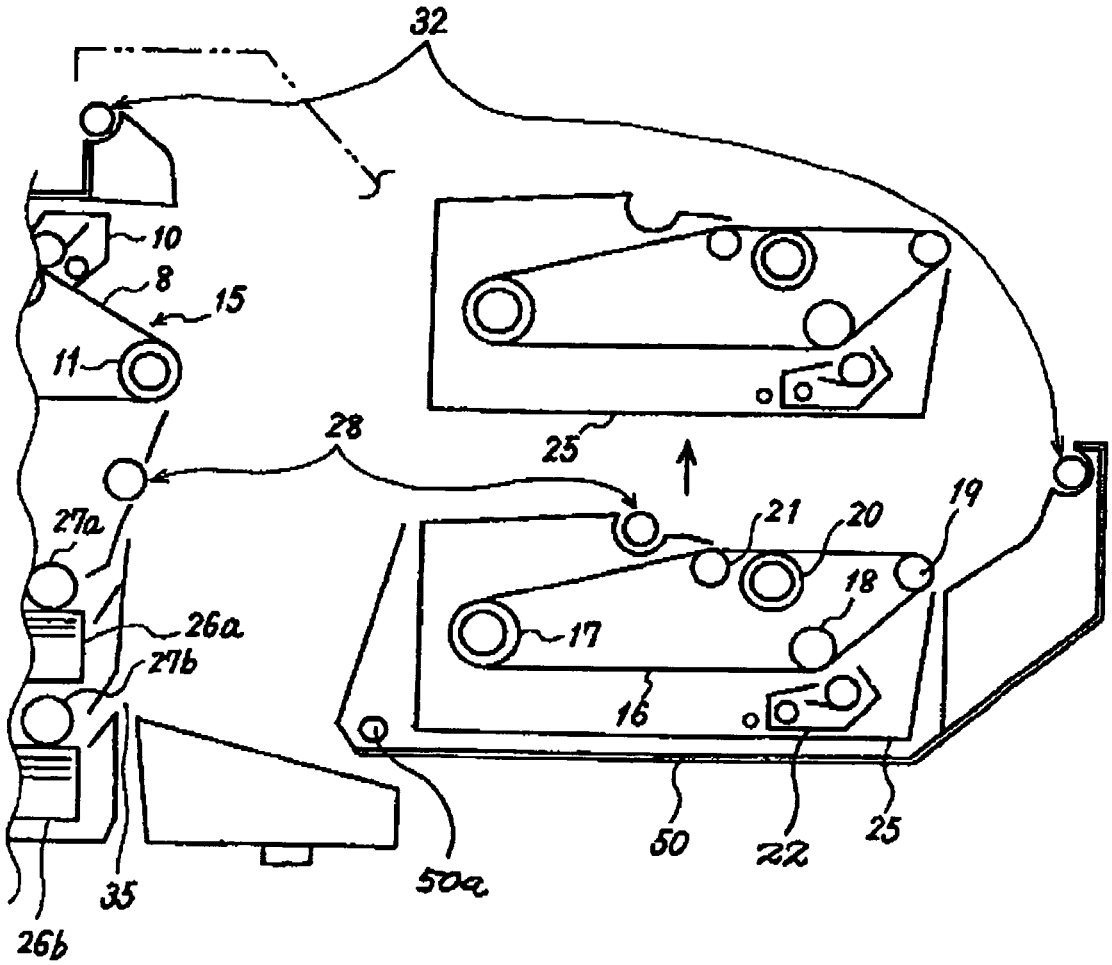
FIG. 4 is a view showing one side end of the illustrative embodiment.

More specifically, as shown in FIG. 4, the side cover 50 is openable clockwise about the shaft 50*a* away from the printer body. In this position, the sheet path, extending from the sheet cassettes 26*a* and 26*b* to the outlet roller pair 32, is separated into two parts in the vertical direction and exposed to the outside. It is therefore possible to easily remove a jamming sheet or maintain or inspect various devices arranged around the sheet path. Also, the second belt cleaner 22 can be readily replaced. Further, the second image transferring unit 25 can be pulled out upward from the side cover 50 for maintenance or replacement.

Figure 5:
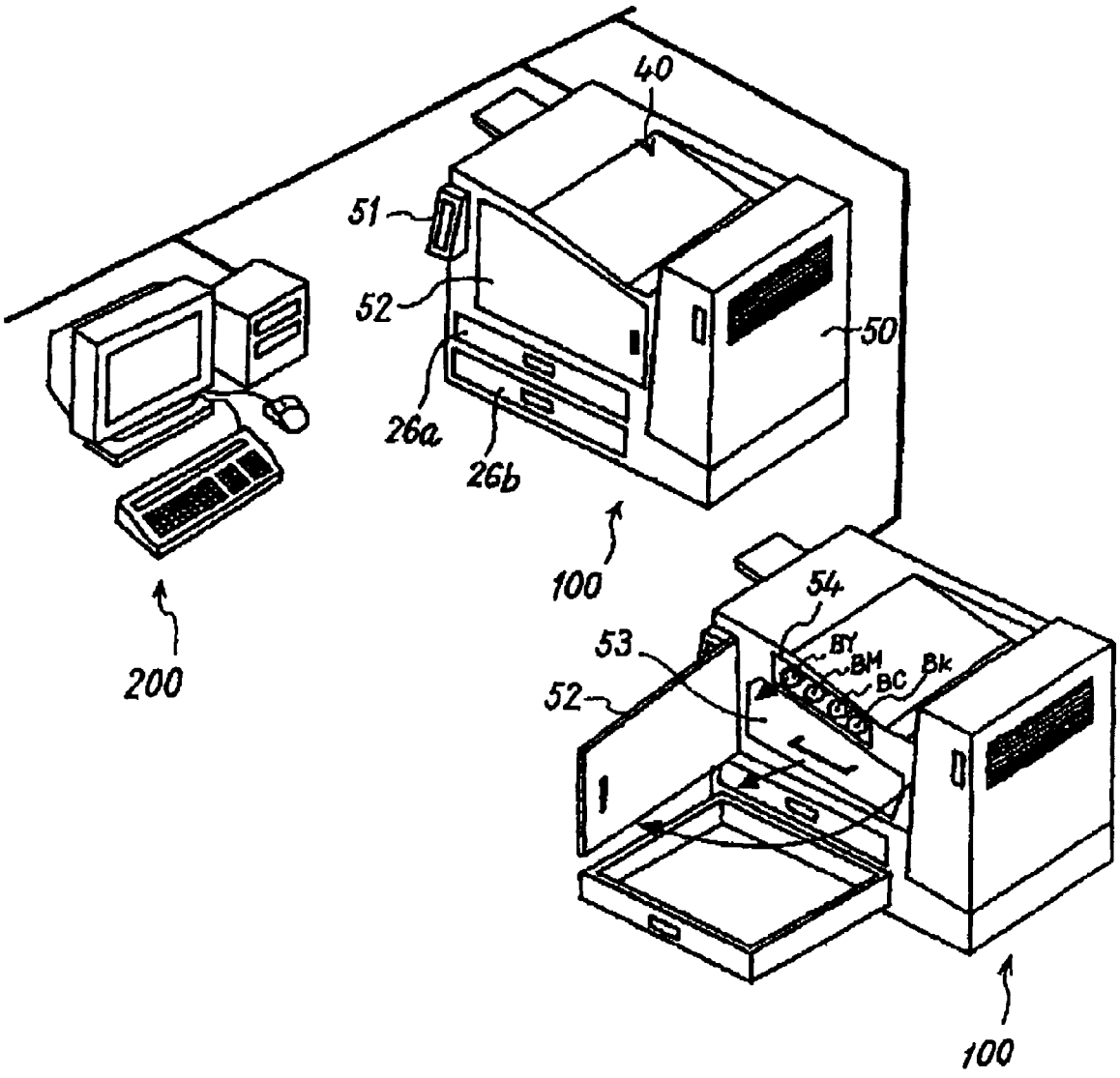
FIG. 5 shows an image forming system including the illustrative embodiment and a personal computer.

As shown in FIG. 5, the printer 100 is capable of forming an image in accordance with an image data signal received from, e.g., a personal computer 200. While the printer 100 is shown as being connected to the personal computer 200 by a cable, the former may, of course, be connected to the latter by radio. An operation and display unit 51, implemented as a touch panel by way of example, is mounted on the left corner of the front face of the printer body.

The operator of the printer 100 is capable of inputting various parameters, including process conditions and sheet conditions, while watching guidance messages appearing on a display which is included in the operation and display unit 51. A mode button, also included in the operation and display unit 51, allows the operator to select either one of a simplex print mode and a duplex print mode. Of course, the simplex/duplex mode and sheet conditions may be designated on the personal computer 200.

When a front door 52, hinged to the front of the printer body, is opened, a frame 53 on which the first image transferring unit 15 is mounted is exposed to the outside. The frame 53 may be slid along guide rails, not shown, out of the printer body so as to expose the first image transferring unit and allow it to be inspected or maintained. Also, when the front door 52 is opened, the ends of the toner bottles BY through BK disposed in the bottle container 54 are uncovered and may be pulled out in the front-and-rear direction of the printer body. This is contrastive to a configuration in which the top of the printer body is implemented as an openable top cover and allows the toner bottles BY through BK when opened. Therefore, in the illustrative embodiment, the toner bottles BY through BK can be mounted or dismounted even when a scanner, not shown, is mounted on the top of the printer 100 in order to constitute a copier.

The sheet cassettes 26*a* and 26*b* are mounted on the printer body below the front door 52 and slidable out of the printer body in the front-and-rear direction of the printer body. The front door 52 therefore does not obstruct the mounting or the dismounting of the sheet cassettes 26*a* and 26*a* or the operation of the operation and display unit 51.

Figure 6:
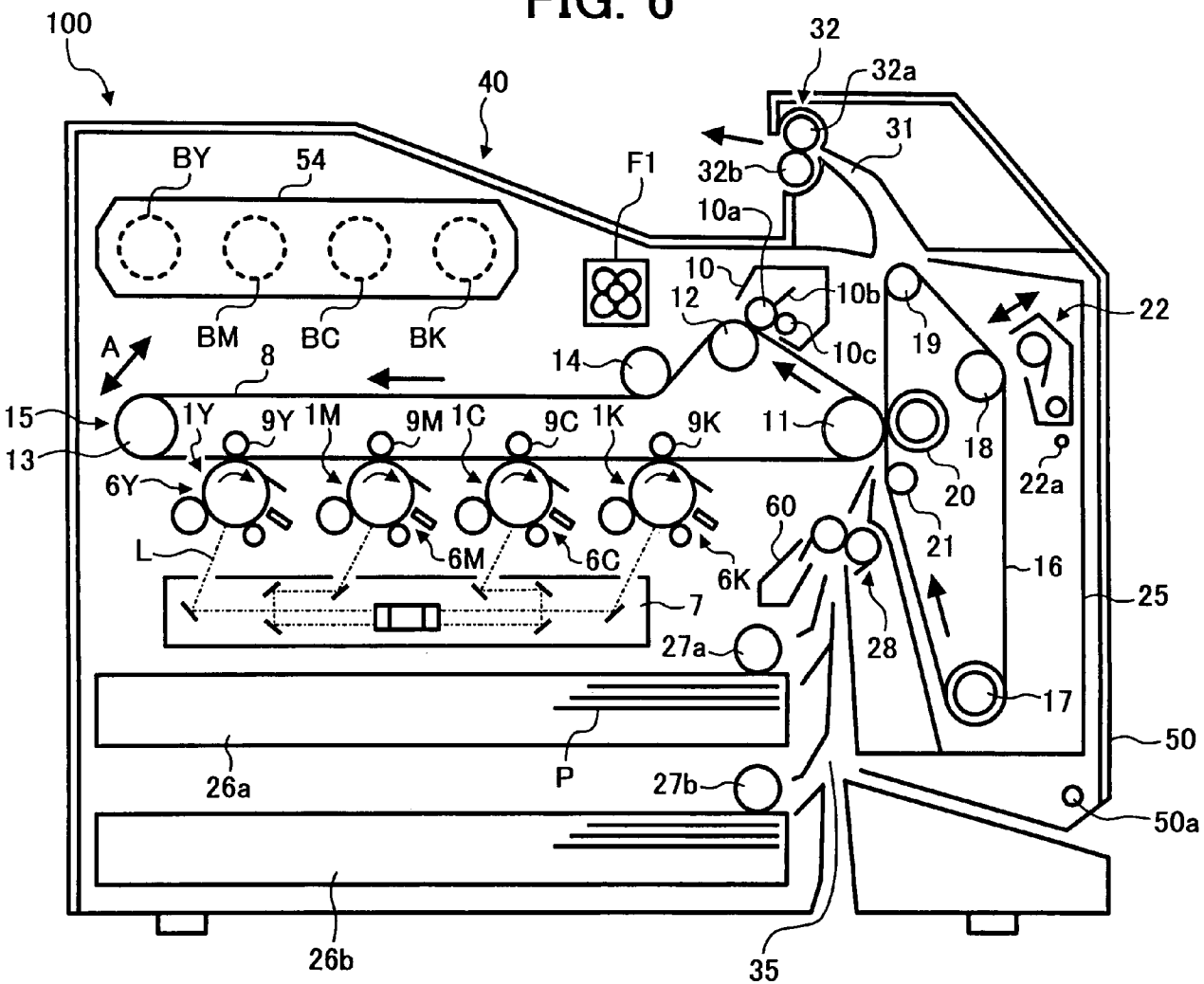
FIG. 6 is a view demonstrating how a first image transferring unit included in the illustrative embodiment is movable.

As shown in FIG. 6, the first image transferring unit 15 is bodily movable about the first heat roller 11 in a direction indicated by an arrow A, causing the first belt 8 to move into or out of contact with the drums 1Y through 1K. In the illustrative embodiment, the side cover 50 is opened or the frame 53 of the first image transferring unit 15 is slid out of the printer body after the first belt 8 has been released from the drums 1Y through 1K. Therefore, it is possible to open the side cover 50 or to pull out the frame 53 without scratching the first belt 8 or the drums 1Y through 1K.

Figure 7:
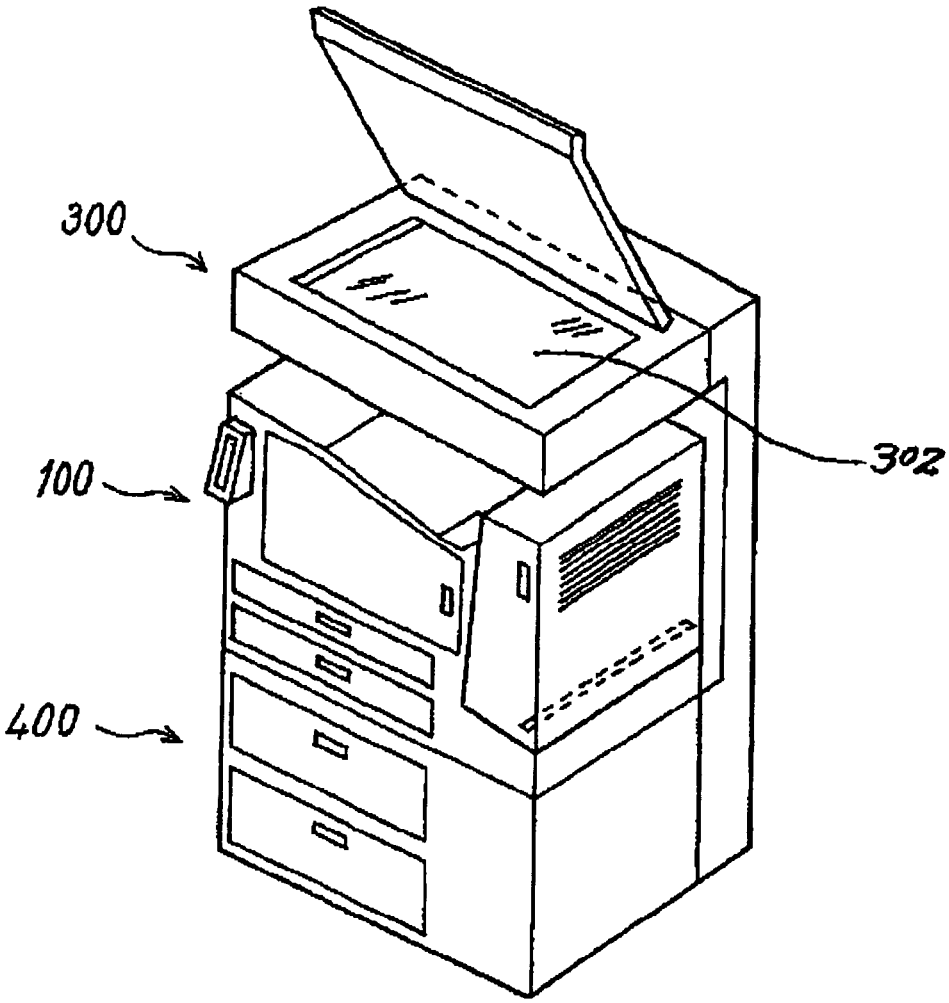
FIG. 7 is an isometric view showing a copier constituted by the illustrative embodiment and a scanner.

FIG. 7 shows the printer 100 combined with a scanner 300 and operable as a copier. As shown, the scanner 300 is mounted no the top of the printer body and reads image information out of a document laid on a glass platen 302 while sending the image information to the previously mentioned image data processor. In FIG. 7, a sheet bank 400 is positioned below the printer 100 and stores a large number of sheets P. These sheets P can be fed to the printer 100 by twos.

Figure 8:
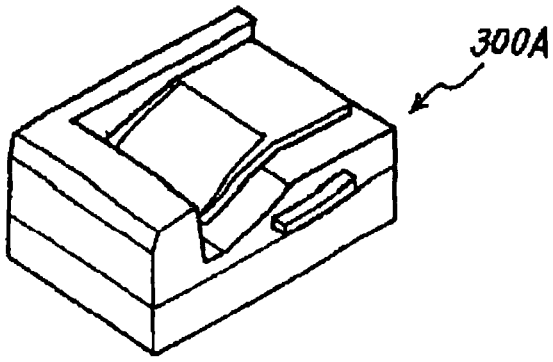
FIG. 8 is an isometric view showing a scanner with an ADF (Automatic Document Feeder) applicable to the copier of FIG. 7.

FIG. 8 shows a scanner 300A with an ADF also applicable to the printer 100. FIG, 9 shows the scanner 300A in a section. As shown, the scanner 300A is generally made up of a scanner section 310 and an ADF section 350. The scanner section 310 includes a document frame 301 and a casing provided with a first and a second glass platen 302 and 303, respectively. A first carriage 305, loaded with a light source 304 and a first mirror, and a second carriage 306, loaded with a second and a third mirror, are disposed in the scanner section 310 and movable in parallel to the first glass platen 302 while scanning a document. The second carriage 306 is caused to move at one-half of the speed of the first carriage 305. Light from the light source 304 is sequentially reflected by the first, second and third mirrors and then focused on a CCD (Charge Coupled Device) image sensor 308 by a stationary lens 307. The resulting image data output from the CCD image sensor 308 are suitably processed as digital data and then sent to the printer 100 or sent to a remote station via a telephone line as facsimile data.

Figure 9:
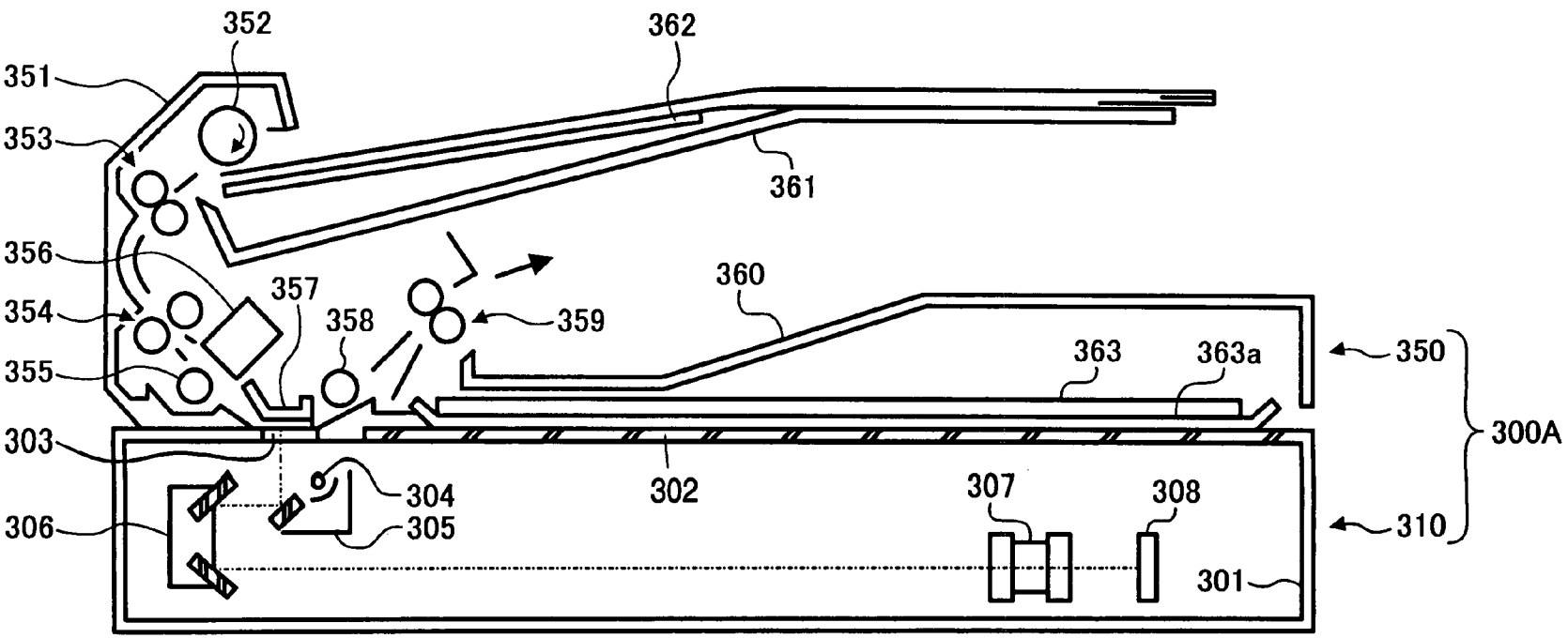
FIG. 9 is a vertical section of the scanner with an ADF.

The ADF section 350 includes a first and a second press plate 363 and 357, respectively, each of which presses a document against the first or the second glass platen 302 or 303, respectively. The ADF section 350 is openable about a shaft, not shown, away from the glass platen. When the ADF section 350 is closed, the first press plate 363 can press even a book or similar relatively thick document against the first glass platen 302. Sheet documents not bound like a book may be stacked on a movable plate 362, which is included in a document tray 361, with the first or odd page facing upward. When the operator inputs a scan start command, a pickup roller 352, contacting the top document, rotates in a direction indicated by an arrow in FIG. 9 to thereby pay out the top sheet to a conveying portion 351. In the conveying section 351, a reverse roller 353 returns documents underlying the top document, allowing only the top document to be surely fed. Subsequently, the document is conveyed by roller pairs 353, 354 and 358 and then driven out to a stack tray 360 by an outlet roller pair 359 with the first surface thereof facing downward.

While the document is being conveyed, as stated above, an image sensor 356 reads image information present on the second or even page of the document. Subsequently, when the document is moving between the second press plate 357 and the second glass platen 303, the scanner section 310 reads image information present on the first surface of the document. At this instant, the first and second carriages 305 and 306 are held stationary. A white sheet 363*a* is adhered to part of the first press plate 363 expected to contact the document, so that the reading means is prevented from reading the color of the press plate 363 as a background when the document is extremely thin. For the same reason, the roller 355 and second press plate 357 are also provided with white surfaces.

Figure 10:
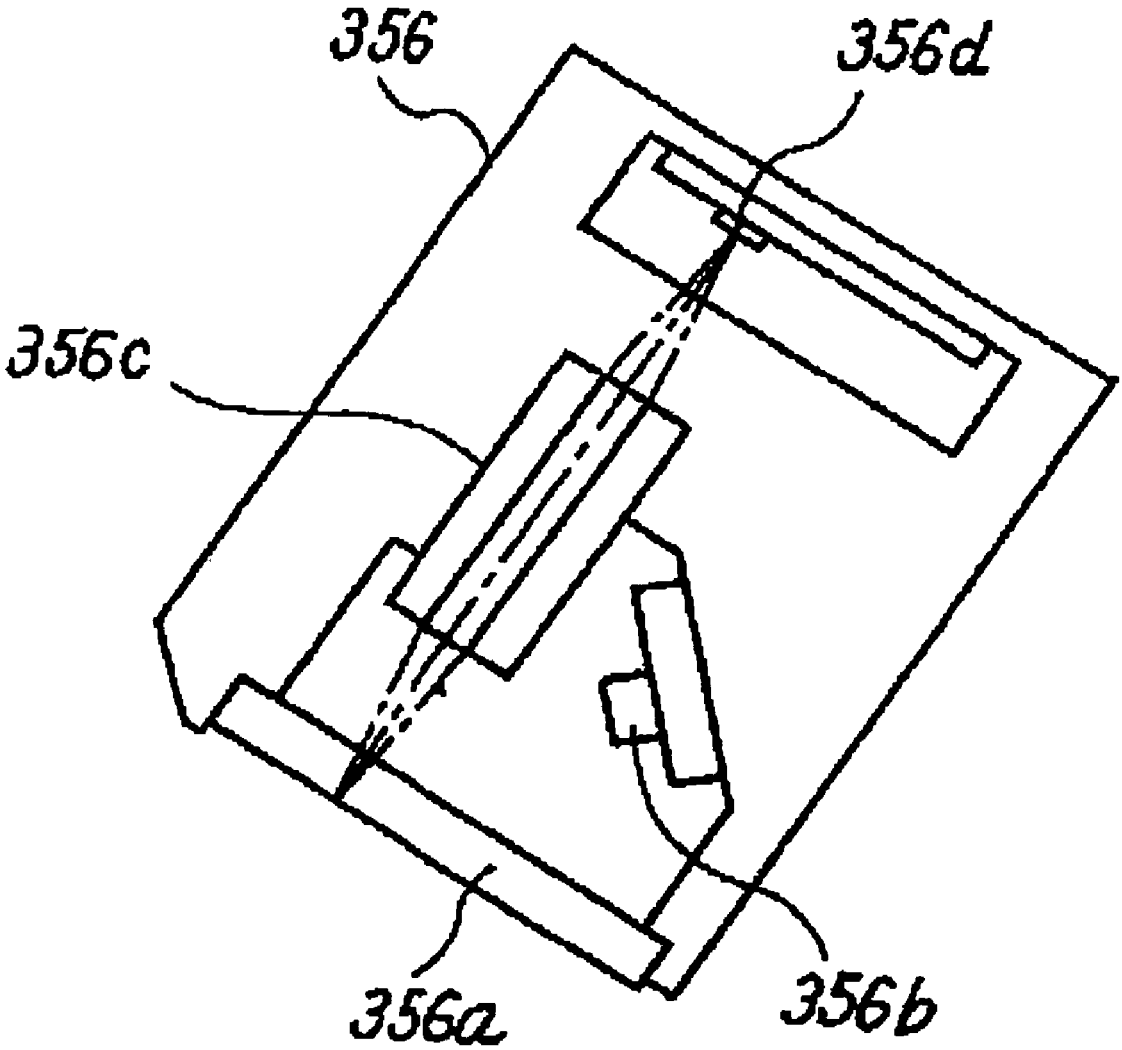
FIG. 10 is a sectional plan view showing an image sensor included in the scanner with an ADF.

FIG. 10 shows a specific configuration of the image sensor 356 in a sectional plan view. As shown, the image sensor 356 includes a glass sheet 356*a* expected to face a document, an LED array or light source 356*b* for illuminating a document, a lens array or focusing device 356*c*, and an equimagnification sensor 356*d*. Use may alternatively be made of a contact sensor not including a focusing lens.

When a book or similar relatively thick document is set on the glass platen 302 and pressed by the press plate 363, the ADF section 350 rises above a preselected position. As a result, the second press plate 357 also rises above the second glass platen 303. In the illustrative embodiment, a sensor, not shown, is provided for sensing the rise of the second press plate 357 above the second glass platen 303. The image sensor 356 is inhibited from performing reading operation in response to the output of the above sensor. This prevents a sheet document from being read when a thick document is present on the first glass platen 302.

Assume that when sheet documents are continuously read by the image sensor 356, another document should be copied by interrupt processing. Then, the operator presses an interrupt button, not shown, to thereby interrupt the reading operation under way. The operator then opens the ADF section 350 while maintaining the sheet documents on the document tray 361 and stack tray 360 and then lays another desired document on the first glass platen 302. Subsequently, the operator again closes the ADF section 350 and presses an interrupt scan button.

Characteristic arrangements of the illustrative embodiment will be described hereinafter. The transfer of the first and second toner images at the secondary image transfer nip can be effected without heating toner to its melting point or softening point or above. However, fixation is attainable only when toner grains are melted or softened to adhere to the delicate undulation of the sheet surface, so that toner must be heated to its melting point or softening point or above. In light of this, in the illustrative embodiment, the length of the secondary image transfer nip is selected to be great enough to heat toner grains forming the first and second toner images to the melting point or the softening point or above. This allows the toner images to be more surely fixed on opposite sides of the sheet P.

Referring again to FIG. 3, the secondary image transfer nip is formed by the surfaces of the first and second belts 8 and 16 contacting each other when the sheet P is absent. More specifically, the nip extends from a point P2 where the belts 8 and 16 start contacting each other to a point P3 where they start parting from each other. The first heat roller 11 starts contacting and heating the first belt 8 at a point P1 upstream of the nip between the points P2 and P3 in the direction of belt movement. However, in the region between the points P1 and P2 where the first and second belts 8 and 16 are spaced from each other, the heat of the first heat roller 11 is not transferred the portions of the belts 8 and 16 contacting each other. This is also true with the region between the point P3 and a point P4 where the belts 8 and 16 are spaced from each other. That is, the first heat roller 11 heats the nip only between the points P2 and P3. In this sense, in the illustrative embodiment, the entire nip constitutes a heating range heated by the heating means.

It is to be noted that at the inlet of the nip the portions of the belts 8 and 16 contacting each other are heated by the second main heat roller 21 as well, and that at the outlet of the nip the above portions are heated by the second auxiliary heat roller 20 as well. Point P0 is where belt 16 begins to contact second main heat roller 21 and point P5 is where belt 16 begins to part from second auxiliary roller 20.

The first roller 11 plays the role of a first heating member for heating the first belt 8 from the inner surface of the belt 8. The second auxiliary heat roller 20 and second main heat roller 21 each play the role of a second heating member for heating the second belt 16 from the inner surface of the belt 16. This configuration allows the nip to be efficiently heated in a short period of time, compared to a configuration in which the nip is heated only from the inner surface of one of the belts 8 and 16.

As stated above, the controller of the printer 100 ON/OFF controls the heating means of the first heat roller 11 in accordance with the surface temperature of the first heat roller 11 to thereby maintain the surface temperature at preselected one. This is also true with the surface temperatures of the second main and auxiliary heat rollers 21 and 20. Preselected temperatures assigned to the heat rollers 11, 20 and 21, i.e., the preselected temperature assigned to the heating means is higher than the melting point or the softening point of the toners Y through K stored in the toner bottles BY through BK by 5° C. to 50° C.

When linear velocity at the secondary image transfer nip is extremely low, the first and second belts 8 and 16 are sufficiently heated and allow the toners to be heated substantially to the preselected temperature. In practice, however, it is difficult, under general process linear velocity conditions, to allow the belts 8 and 16 and sheet P to contact each other over a sufficient period of time, so that the first and second toner images can be heated only to temperature far lower than the preselected temperature. This is apt to make image transfer and fixation extremely difficult.

To solve the above problem, in the illustrative embodiment, the nip heating range mentioned earlier is made large enough to surely heat the first and second toner images even at preselected process linear velocity and preselected temperature, thereby guaranteeing a contact time long enough to implement image transfer and fixation. It is noteworthy that the secondary nip, which forms the nip heating range in its entirety, readily guarantees the above contact time. It is to be noted that the preselected temperature should preferably be higher than the melting point or the softening point of toner by 10° C. to 30° C.

To measure the softening point of toner, 1 g of toner powder is filled in a nozzle having a diameter of 1.0 mm and a length of 1.0 mm and subject to a pressure of 1.9612 MPa and temperature elevation rate of 6° C./min by a flow tester CFT-500C (trade name) available from Shimadzu Corp.

Temperature at which one-half of the toner flew out of the nozzle is the softening point of the toner.

So long as the printer body is delivered together with the toner bottles BY through BK without exception, the preselected temperature should only be matched to the measured softening point of toner. On the other hand, when the printer bottle is delivered alone independently of the toner bottles BY through BK, it is necessary to specify toner applicable to the printer 100 and match the preselected temperature to the softening point of the specified toner later.

A period of time over which the sheet P passes through the nip heating region or entire secondary image transfer nip should preferably be 0.05 second or above. Should this period of time be shorter than 0.05 second, it would be difficult to effect image transfer and fixation under the following condition when consideration is given to the heat transfer coefficients of the first and second belts 8 and 16. The above condition is such that the preselected temperature is 50° C. or below when the general process linear velocity is used. Stated another way, only if the nip region is long enough to guarantee the period of time of 0.05 second or above at the general process linear velocity, then image transfer and fixation can be realized at the preselected temperature of 50° C. or below. The upper limit of the period of time concerned should preferably be 1.0 second or below The first and second belts 8 and 16 should preferably be 1 μm to 400 μm thick each. Thickness below 1 μm would cause the belts 8 and 16 to crease while in movement and fail to function as intermediate image transfer bodies while thickness above 400 μm would bring about critical heat losses ascribable to radiation and cooling. The thickness should more preferably be between 10 μm and 200 μm or even more preferably between 30 μm and 100 μm.

Referring again to FIG. 1, the cooling member or tension roller 14 presses the first belt 8 in a concave configuration from the outer surface of the belt 8. The cooling member 14 absorbs heat from the belt 8 while radiating it to thereby cool off the belt 8. The cooling member 14 is located at a position where it cools off part of the belt 8 moved away from the secondary image transfer nip, but not reached the Y primary image transfer nip where the belt 8 faces the drum or most upstream drum 1Y. The cooling member 14 therefore serves as first belt cooling means for cooling the above part of the belt 8. Otherwise, the part of the belt 8 heated at the secondary image transfer nip would transfer the heat to the drums 1Y through 1K at the consecutive primary image transfer nips and would thereby deteriorate them and lower image quality.

If desired, the cooling member 14, directly contacting the belt 8, may be replaced with any other first belt cooling means, e.g., an air stream. However, the cooling member 14 is desirable because an air stream, for example, is apt to disturb the toner images formed on the drums 1Y through 1K or the belt 8. The cooling member 14 should preferably be implemented as a heat pipe.

A heat pipe is made up of a metallic pipe portion and a plurality of radiation fins formed on the outer periphery of one end of the pipe portion. The pipe portion rotates in contact with the first belt 8 and stores a cooling liquid therein. The pipe portion in rotation absorbs the heat of the belt 8 while transferring it to the cooling liquid. As a result, the cooling liquid is evaporated and flows to the inside of the individual radiation fins for thereby heating the fins. The fins, in turn, radiate heat in contact with surrounding air while rotating about the axis of the pipe portion. Consequently, part of the gas inside the fins is cooled off and liquefied thereby.

With the heat pipe, it is possible to efficiently cool off the first belt 8 without resorting to any special drive source. Further, extremely rapid cooling free from irregularity in the axial direction of the pipe is achievable, so that any irregularity in the temperature of the belt 8 can be corrected in the widthwise direction of the belt 8.

The first belt cleaner or first cleaning means 10 cleans part of the first belt 8 moved away from the secondary image transfer nip, but not reached the cooling member 14. The first belt cleaner 10 can therefore clean the belt 8 before the toner softened at the secondary image transfer nip is cooled off by the cooling member 14 and caused to adhere to the belt 8 thereby. In the case where the toner is hardened due to heat radiation to a such a degree that it cannot be easily removed during movement from the outlet of the secondary image transfer nip to the belt cleaner 10, heating means may be disposed in the belt cleaner 10 in order to again soften the toner with heat.

Figure 11:
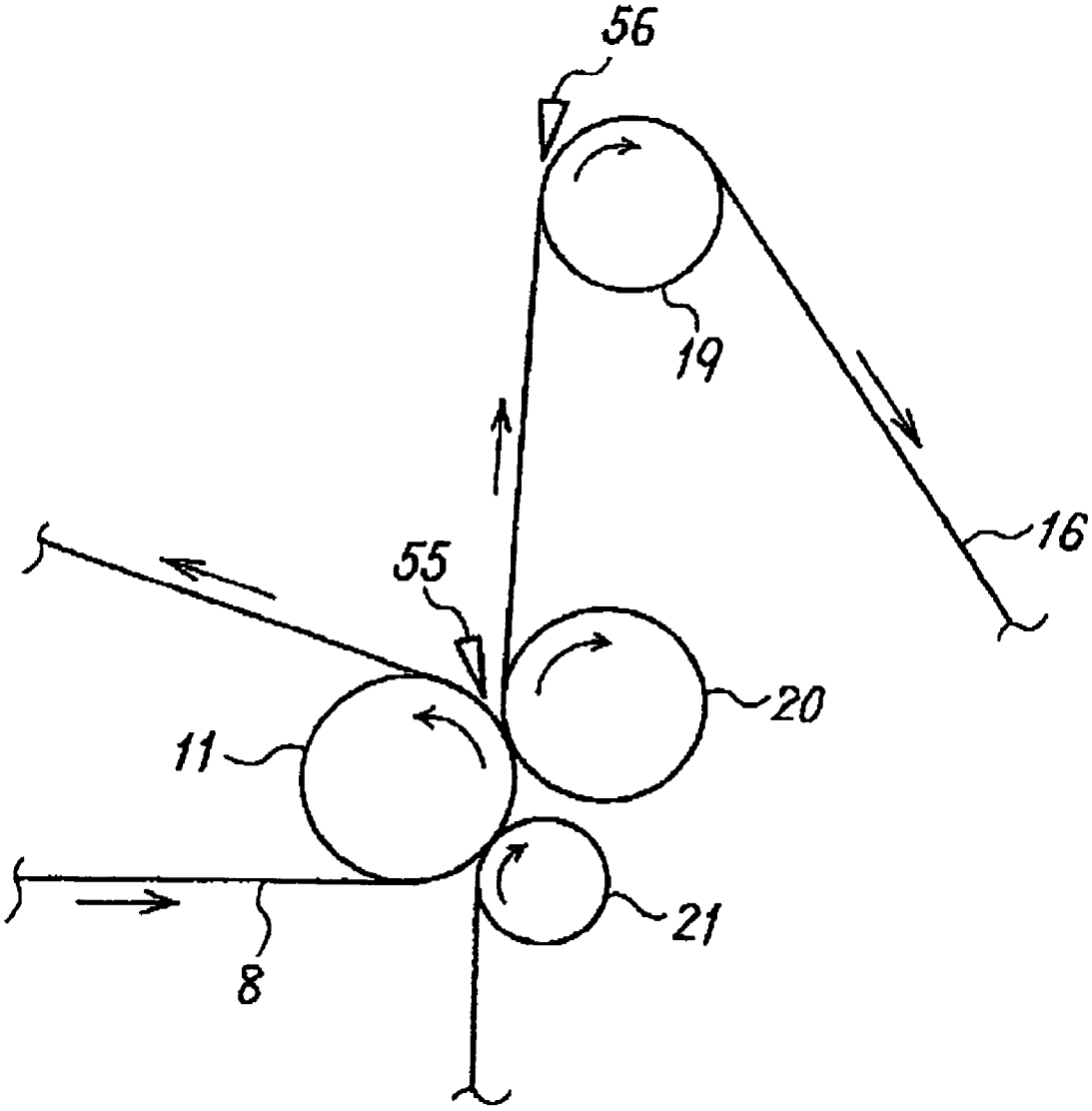
FIG. 11 is a view showing a first modification of the illustrative embodiment.

Reference will be made to FIG. 11 for describing a first modification of the illustrative embodiment. As shown, the first modification includes a first and a second peeler 55 and 56. The sheet P is peeled off from the first belt 8 and then from the second belt 16 on a curvature basis, as stated earlier. However, it may occur that the sheet P does not part from the first belt 8 at the outlet of the secondary image transfer nip, but remains on the belt 8. For example, when the first toner image is accidentally softened more than the second toner image, adhesion, acting between the first belt 8, second toner image and sheet P overcomes adhesion acting between the sheet P, first toner image and second belt 16, causing the sheet P to remain on the first belt 8. Also, the sheet P may fail to part from the second belt 16 and enter the sheet path 31.

In the first modification, the first peeler or separating member 55, adjoining the outlet of the secondary image transfer nip, surely peels off the sheet P even when the sheet P moves toward the first belt 8 at the outlet, thereby obviating a jam. Likewise, the second peeler 56, adjoining the sheet path 31, surely peels off the sheet P from the second belt 16 even when the sheet P tends to remain on the belt 16, thereby obviating a jam.

The clearance between the first peeler 55 and the first belt 8 and the clearance between the second peeler 56 and the second belt 16 should preferably be between 0.01 mm and 5 mm each. Clearance below 0.01 mm is likely to cause the peelers and belts to contact each other and damage the belts. Clearance above 5 mm critically obstructs the separation of the sheet P from the belts.

A second modification of the illustrative embodiment will be described with reference to FIG. 12. The first and second belts 8 and 16 start parting from each other at the outlet of the secondary image transfer nip, so that either one of the belts 8 and 16 starts parting from the sheet P, as stated previously. At this instant, if the toner of the toner image, intervening between the belt that starts parting and the sheet P, is too soft, then part of the toner image is left on the belt (so-called toner offset), resulting in low image quality. More specifically, in the illustrative embodiment, the second toner image, intervening between the first belt 8 and the sheet P is apt to bring about hot offset. It is therefore preferable to soften, at the second image transfer nip, the toner with heat and then cool it off to a level that does not bring about hot offset. For this purpose, the second modification includes, in addition to the heating range, a cooling range for cooling the secondary image transfer nip. By hardening the toner by cooling it, it is possible to make each of the first and second toner images a single mass for thereby effectively obviating hot offset.

Figure 12:
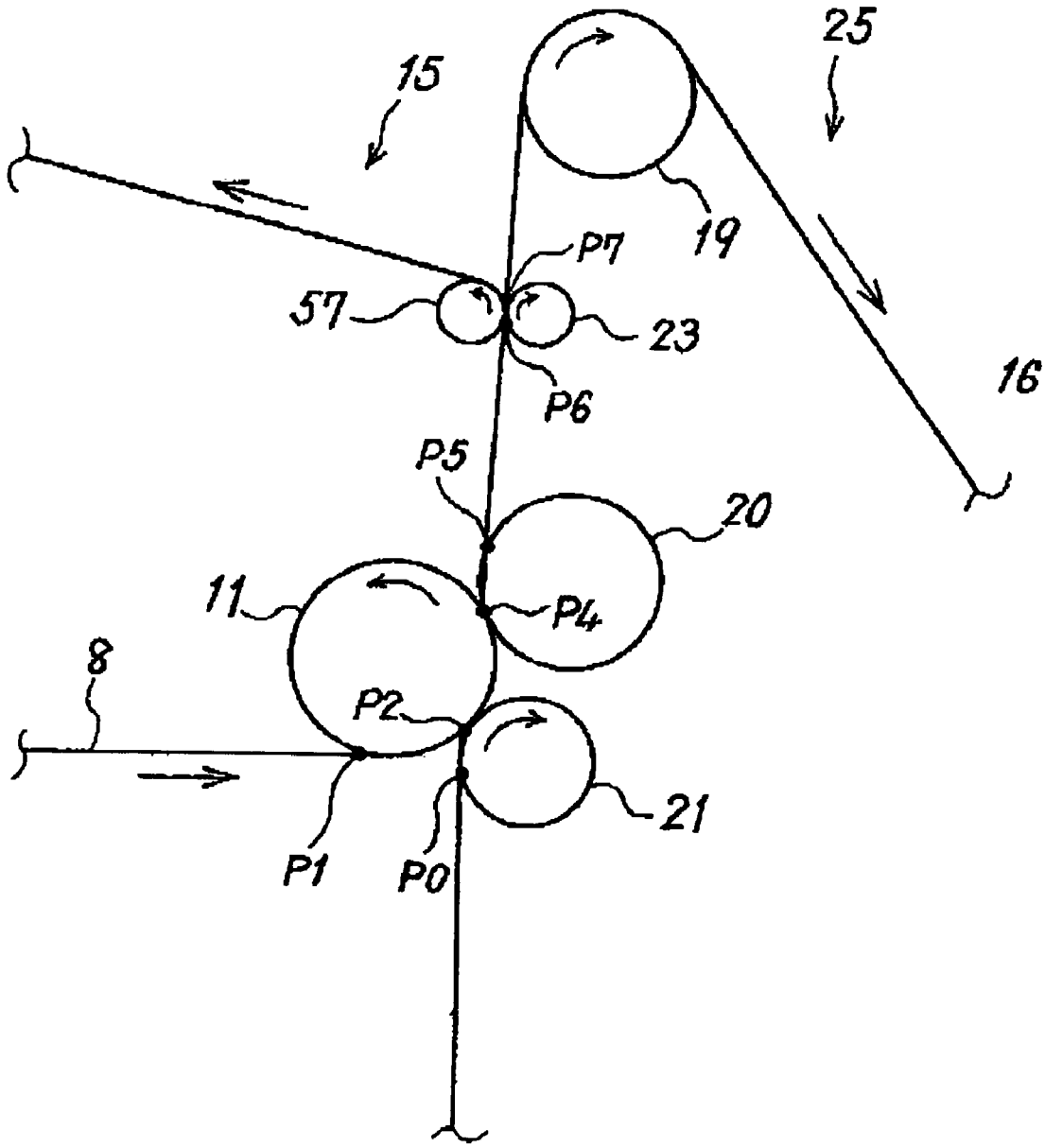
FIG. 12 is a view showing a second modification of the illustrative embodiment.

As shown in FIG. 12, the second modification additionally includes an auxiliary roller 23 over which the second belt 16 is passed between the second auxiliary beat roller 20 and the peel roller 19. Also, the first image transferring unit 15 additionally includes a nip extend roller 57 that presses part of the first belt 8 moved away from the first heat roller 11 toward the second belt 16 for thereby extending the secondary image transfer nip, as will be seen by comparing FIGS. 12 and 3. More specifically, in the second modification, the first and second belts 8 and 16 remain in contact with each other even after moved away from the position where the first and second heat rollers 11 and 20 face each other. The belts 8 and 16 start parting from each other at the outlet of the nip positioned at a point P7 that is noticeably shifted from the point P3, FIG. 3, toward the peel roller 19. At the point P7, the nip extend roller 57 and auxiliary roller 23 face each other.

The secondary image transfer nip thus extended is heated from the point or nip inlet P2 to a point P5 where the second auxiliary roller 20 and second belt 16 start parting from each other. In this sense, the region between the points P2 and P5 constitutes the heating range. Subsequently, the belts 9 and 16 both part from the heating members in the region downstream of the point P5 and therefore start naturally radiating heat. In this sense, the region between the point P5 and a point or nip outlet P6 constitutes a cooling range.

In the configuration described above, the toner of the first and second toner images, heated in the nip heating region between the points P2 and P5 to the melting point or the softening point or above, penetrates into the fibers of the sheet P. Subsequently, the toner is cooled off to temperature below the melting point or the softening point in the cooling range between the points P5 and P7 and hardened thereby. This successfully obviates hot offset and allows the toner to be easily cooled off below the melting point or the softening point in the cooling range.

In FIG. 12, the first heat roller 11 plays the role of a belt support member supporting the first belt 8 at the same time while the second auxiliary and main rollers 20 and 21 play the role of belt support members supporting the second belt 16 at the same time. The secondary image transfer nip can therefore be heated in compact layout.

As shown in FIG. 12, the first belt 8 and first heat roller 11 start parting from each other at the point P4 while the second belt 16 and second auxiliary heat roller 20 start parting from each other at the point P5. Further, the first and second belts 8 and 16 start entering the position where the nip extend roller 57 and auxiliary roller 23 face each other.

Part of the first belt 8 extending from the point P4 to the point P6, i.e., from the first heat roller 11 to the nip extend roller 57 constitutes a portion downstream of the first heating position. Also, part of the second belt 16 extending from the point P5 to the point P6 constitutes a portion downstream of the second heating position. By causing such two portions to contact each other, it is possible to easily implement the cooling range between the points P5 and P7, as illustrated.

Generally, fixability of toner on the sheet P is dependent on a certain viscosity value more than on the viscosity of toner at the melting or softening point. More specifically, even toner whose fixability is short at viscosity corresponding to the melting or the softening point can be desirably fixed when softened to a certain viscosity value. Also, hot offset is dependent on a certain viscosity value more than on toner viscosity at the melting or the softening point; even toner, which is apt to bring about some hot offset at viscosity to hold when the toner is cooled off to temperature slightly lower than the melting or the softening point and slightly hardened thereby, can obviate hot offset if hardened to a certain viscosity value.

We experimentally found that the viscosity value that implements desirable fixability was $10^6$ Pa or below, but $10^5$ Pa or above. In light of this, in the second modification, the heating range is extended to such a degree that the toner is sufficiently heated and provided with viscosity of $10^6$ Pa or below. Also, the cooling range is extended to such a degree that the toner is sufficiently cooled and provided with viscosity of $10^5$ Pa or above.

In the illustrative embodiment and modifications thereof, the drums 1Y through 1K may be replaced with photoconductive belts, in which case each belt will serve as the first belt. The powdery toner may be replaced with a developing liquid containing toner and carrier liquid. Of course, the present invention is applicable even to an image forming apparatus of the type including a single photoconductive element or image carrier for forming a monochromatic image.

The present invention is applicable not only to an electrophotographic printer but also to a direct recording type of image forming apparatus configured to cause a toner jetting device to jet toner in the form of a group of drops toward an intermediate image transfer body or a recording medium. In this case, the intermediate image transfer body or the recording medium serves as an image carrier.

As stated above, the illustrative embodiment confines the heating temperature of the heating means in the particular range while realizing both of one-pass type of duplex image transfer and thermal, simultaneous image transfer and fixation.

An alternative embodiment of the present invention, directed mainly toward the second object stated earlier, will be described hereinafter.

In the thermal image transferring device of the type including the first and second image carriers, toner images carried on the two image carriers are respectively transferred to opposite surfaces of the sheet or recording medium by being heated. Consequently, the image carriers themselves are heated. It follows that the length of the path over which each image carrier endlessly moves varies due to thermal expansion in accordance with the coefficient of thermal coefficient and temperature. In the illustrative embodiment, the coefficients of thermal expansion of the two image carriers are selected such that a difference between the path lengths of the two image carriers varies above an allowable range within a possible temperature range in which the image carriers may be heated. Therefore, even when the temperatures of the two image carriers randomly vary during image formation, the difference between the path lengths of the image carriers is successfully prevented from varying above the allowable range.

The coefficient of thermal expansion of each image carrier maybe determined by the following method. Assume that the image carrier has a coefficient of thermal expansion or linear expansion of $\alpha$ and moves over a path whose length at 0° C. is $L_0$. Then, the length $L_t$ of the path length at t° C. is expressed as;

$$L_t = L_0(1+\alpha \times t) \quad \text{Eq. (1)}$$

Let the factors of the first image carrier and those of the second image carrier be distinguished by suffixes "1" and "2", respectively. A difference ($L_2$–$L_1$) between the path lengths of the two image carriers is expressed as:

$$L_{t2}-L_{t1}=(L_{02}-L_{01})+(\alpha_2\times L_{02}-\alpha_1\times L_{01})t \quad \text{Eq (2)}$$

Therefore, when the coefficient of friction of the first image carrier is α1, the difference ($L_2$–$L_1$) can be maintained constant without regard to temperature if the coefficient of friction α2 of the second image carrier is α1 multiplied by ($L_{01}/L_{02}$). Because the temperature distribution of each image carrier irregular in the direction of movement, it is preferable to take account of such irregularity.

The illustrative embodiment, also implemented as an electrophotographic printer, will be described more specifically hereinafter. Because the illustrative embodiment is substantially identical with the previous embodiment as to the general construction and operation of the printer, the following description will concentrate on differences therebetween.

In the illustrative embodiment, the first belt 8 does not easily expand or contract and has preselected resistivity necessary for electrostatically transferring the toner images from the drums 1Y through 1K. The preselected resistivity includes volume resistivity of $10^6$ Ω·cm or above, but $10^{12}$ Ω·cm or below, and surface resistivity of $10^8$ Ω·cm$^2$ or above, but $10^{14}$ Ω·cm$^2$ or below. To prevent such resistivity from varying due to heat, it is preferable to add carbon, metal oxide or similar electron conduction type of resistance control agent.

The firs belt 8 should preferably be 30 μm thick or above, but 500 μm thick or below, more preferably 30 μm thick or above, but 100 μm thick or below. The base of the first belt 8 should preferably be formed of a material that thermally deforms little and contains PI (polyimide), PAI (polyamide), PBI (polybenzoimidazol) or similar imide group. A surface layer, implemented by silicone rubber, Teflon rubber, Teflon or similar fluorocarbon resin that is heat-resistant and has lower surface energy, should preferably be coated on the base. The belt 8 should preferably contact the toner at an angle of 110° and have surface roughness Rz of 1 m or above, but 4 μm or below. In the illustrative embodiment, the belt 8 is made up of a PFA tube whose thickness is between 20 μm and 30 μm and seamless polyimide whose thickness is between 20 μm and 50 μm and adhered to the PFA tube.

The thickness of the base of the first belt 8 should preferably be two times as great as the thickness of the surface layer within the total thickness range stated above. This insures stable drive while providing the belt 8 with sufficient mechanical strength and sufficiently enhances efficient heat transfer at the secondary image transfer nip.

In the illustrative embodiment, the second belt 16 is identical in resistivity, resistance and structural ratio with the first belt 8. The base of the belt 16 is formed with the same material as the base of the belt 8. While the surface layer of the belt 16 is identical in material with the surface layer of the belt 8, the former has higher surface resistance than the latter in order to allow the first toner image to be adequately transferred from the belt 8 to the belt 16. Among the rollers 20, 19, 18, 17 and 21 shown in FIG. 1, the roller 20 serves as heating means for heating the belt 16.

The belt 16, like the belt 8, has thickness ranging from 30 μm to 500 μm and includes a base formed of PI, PAI or PBI by way of example. More specifically, the belt 16 should preferably contact toner at an angle of 90° and should preferably have surface roughness ranging from 5 μm and 10 μm. In the illustrative embodiment, the belt 16 is made up of seamless polyimide whose thickness is between 20 μm and 50 μm and ETFE whose thickness is between 20 μm and 50 μm and coated on the seamless polyimide.

The roller 17 over which the second belt 16 is passed plays the role of cooling means for cooling the belt 16. The second belt 16 differs from the first belt 8 in that it originally does not have to be forcibly cooled off because it is free from the problem of toner deposition on the drums. However, the illustrative embodiment assigns the cooling means to the second belt 16 also in order to subject the two belts to substantially identical heating conditions.

In the illustrative embodiment, the circumferential length of the second belt 16 between the secondary image transfer nip and the roller 17 is selected to be substantially equal to the circumferential length of the first belt 8 between the above nip and the tension roller 14.

Heaters of the same wattage are disposed in the first heat roller 11 associated with the first belt 8 and the second heat roller 20 associated with the second belt 16, Belt temperature at the time of image transfer at the secondary image transfer nip is controlled to one between the glass transition temperature and the softening point of toner. The width of the secondary image transfer nip should preferably be between 5 mm and 10 mm. In this connection, the first and second heat rollers 11 and 20 each should preferably be provided with an outside diameter ranging from 40 mm to 60 mm. A rubber layer whose thickness is so selected as to implement the above nip width in consideration of the belt thickness may be formed on the surface of each of the rollers 11 and 20.

Figure 13:
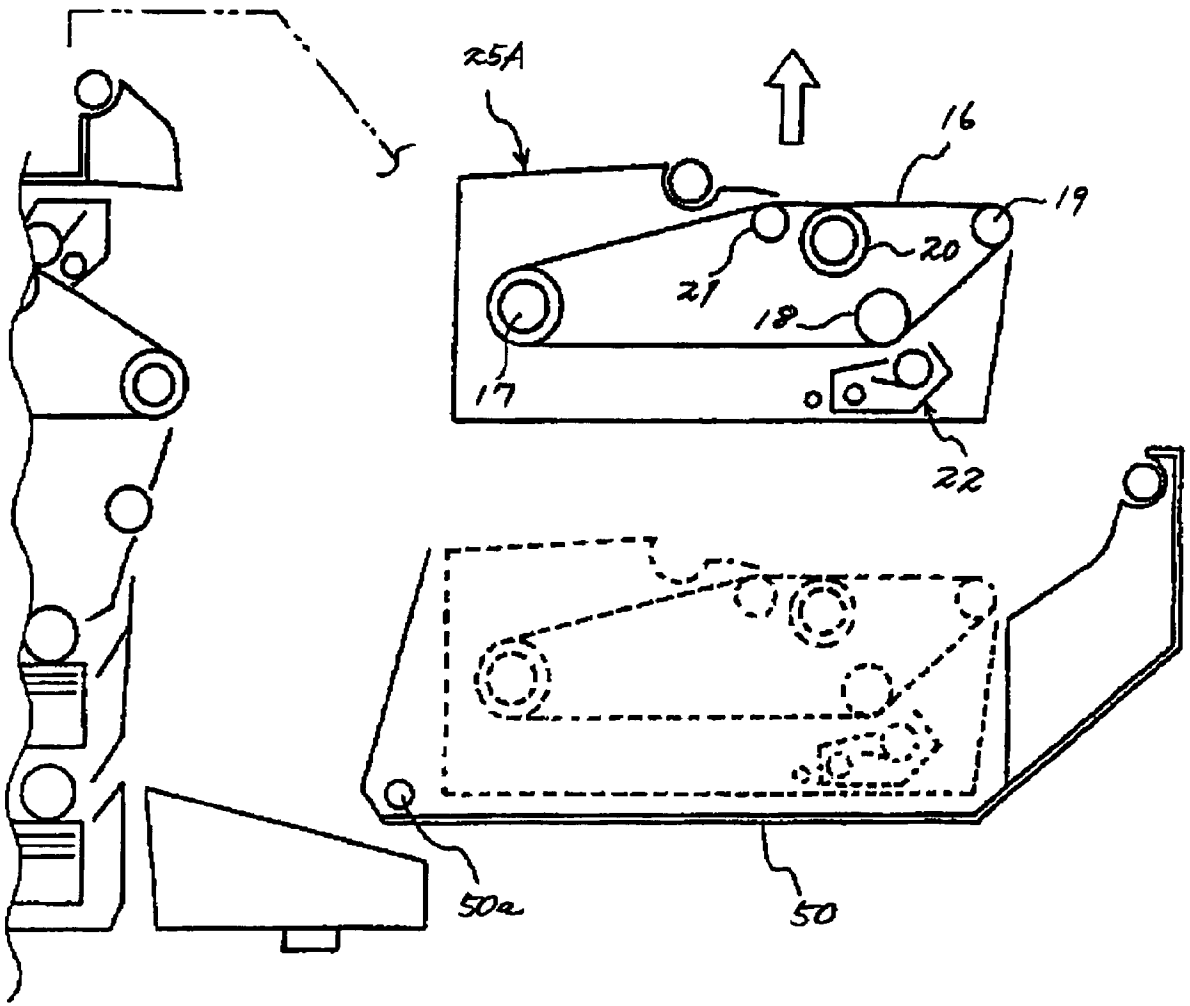
FIG. 13 is a view showing a process cartridge included in an alternative embodiment of the present invention.

As shown in FIG. 13, the second belt 16 and second belt cleaner 22 may be constructed into a single process cartridge 25A. The process cartridge 25A includes a casing 50 angularly movable about a shaft 50*a*. When the life of any part included in the printer ends, the process cartridge 25A may be moved to the position shown in FIG. 13 in order to replace only the above part.

In the illustrative embodiment, the rollers 32*a* and 32*b*, positioned downstream of the secondary image transfer nip in the direction of sheet conveyance, constitute a thermal fixing device. The rollers 32*a* and 32*b*, each accommodating a respective heater therein, nip the sheet P moved away from the secondary image transfer nip. The rollers 32*a* and 32*b* each are made up of a metallic core and a silicone rubber layer formed thereon and having thickness of 2 mm or above, but 5 mm or below. Silicone rubber may be replaced with Teflon or similar resin or rubber having high parting ability. The temperature of the rollers 32*a* and 32*b* is controlled to 160° C. or above, but 200° C. or below.

The operation of the illustrative embodiment is generally similar to the operation of the previous embodiment except for the following. In the case of electrostatic image transfer, if the first and second belts 8 and 16 do not closely contact each other at any portions thereof, discharge or the disturbance of an electric field is apt to occur when the belts 8 and 16 contact or part from each other, causing the toner image to be scattered, blurred or otherwise disturbed. By contrast, thermal image transfer also effected in the illustrative embodiment transfers the toner from the first belt 8 to the second belt 16 with heat and pressure and therefore protects the toner image from the above disturbance.

At the time of thermal image transfer, temperature between the glass transition point and the softening point of toner is applied to the second belt 16 while preselected pressure is applied to the toner. The preselected pressure should preferably be between 2 N/cm$^2$ and 10 N/cm$^2$. The pressure causes the toner on the first belt 8 to plastically deform and bite into the undulation of the second belt 16. At this instant, the toner is transferred to either one of the belts 8 and 16 lower in parting ability, which is represented by the contact angle, and greater in surface roughness that the other. In the illustrative embodiment, the toner is transferred from the belt 8 to the belt 16.

At the secondary image transfer nip, the toner images on the belts 16 and 8 are respectively transferred to the first and second surfaces of the sheet P by the previously stated procedure. More specifically, the toner of the toner images is melted by the heat of the first and second heat rollers 11 and 20 and penetrates into gaps between the fibers of the sheet P. In the illustrative embodiment, the sheet P has surface roughness Rz ranging from 30 $\mu$m to 50 $\mu$m, so that the toner images are temporarily fixed on the first and second surfaces of the sheet P by the anchor effect.

The sheet P, carrying the toner images thus temporarily fixed on both surfaces thereof, is conveyed upward to the nip between the rollers or fixing rollers 32*a* and 32*b*. The rollers 32*a* and 32*b* fix the toner images on the sheet P with heat and pressure by nipping it therebetween. Subsequently, the sheet P is driven out to the stacking section 40 in the same manner as in the previous embodiment.

The illustrative embodiment is also operable in the simplex print mode described in relation to the previous embodiment, as desired.

Figure 14:
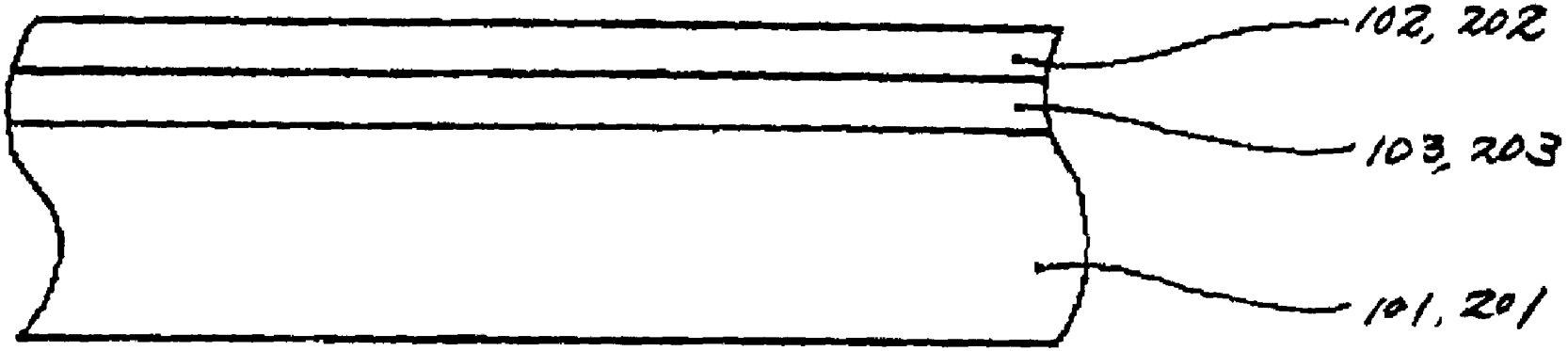
FIG. 14 is a section showing a specific configuration of a first or a second belt also included in the illustrative embodiment.

FIG. 14 shows a specific configuration of each of the first and second belts 8 and 16 that characterizes the illustrative embodiment. As shown, the belts 8 and 16 have the same structure including a base 101 or 201, a primer 103 or 203 formed on the base 101 or 201, and a surface layer 102 or 202 formed on the primer 103 or 203.

In the illustrative embodiment, the heat of the first and second heat rollers 11 and 20 causes the circumferential lengths or path lengths of the first and second belts 8 and 16 to vary due to thermal expansion. Because the bases 101 and 201, surface layers 102 and 202 and primer layers 103 and 203, which cause them to closely adhere to each other, each are formed of the same material. In addition, the belts 8 and 16 have the same circumferential length at preselected temperature.

Further, the first and second belts 8 and 16 are subject to substantially the same heating conditions. More specifically, the temperature variation of the first belt 8 is ascribable to the first heat roller 11 and first belt cleaner 10 while the temperature variation of the second belt 8 is ascribable to the second heat roller 20 and second belt cleaner 22. The belts 8 and 16 both are heated to the same temperature over the same period of time. In addition, the circumferential length of the belt 8 and that of the belt 16 up to the positions where they are cooled by the cooling means 14 and 17, respectively, are the same as each other.

In the conditions described above, the first and second belts 8 and 16 are substantially identical with each other as to the coefficient of thermal expansion, circumferential length at preselected temperature, and heating conditions. It follows that the temperatures of the belts 8 and 16 are identical at all times, and therefore the circumferential lengths of the belts 8 and 16 remain identical without regard to temperature variation. Thus, the circumferential length remains constant during image formation in both of a single print mode and a repeat print mode, reducing the shift of the leading edges of image on both surfaces of the sheet P relative to each other.

If desired, the first and second belts 8 and 16 each may be provided with a single layer structure in place of the laminate structure shown in FIG. 14. In such a case, the belts 8 and 16 each should preferably be formed of Teflon or similar fluorocarbon resin, e.g., PTFE (polytetrafluoroethylene) or PVD (polyvinylidene fluoride) or a material containing an imide group. When the two belts 8 and 16 each are provided with a single layer structure, the coefficient of thermal expansion of the material constituting the belt can be regarded as the coefficient of friction of the belt. This makes it easy to adjust the coefficients of thermal expansion of the belts 8 and 16 and therefore facilitates the production of the belts 8 and 16.

The first and second belts 8 and 16 can sufficiently reduce the shift of the leading edges of images relative to each other if at least their bases 101 and 201 are provided with the same coefficient of friction for the following reason. Generally, the bases 101 and 201 are formed of a material that deforms little while the surface layers 102 and 202 and primer layers 103 and 203 each are formed of a material easier to deform than the bases 101 and 201. Therefore, the amount of expansion or contraction of the entire belt 8 or 16 is substantially determined by the amount of expansion of the base 101 or 201, respectively. It follows that the amount of expansion of the entire belt 8 or 16 is effected by the coefficient of friction of the base 101 or 201, respectively, but is effected little by the coefficient of friction of the surface layer 102 or 202 or that of the primer layer 103 or 203.

While the first and second belts 8 and 16 of the illustrative embodiment have the same circumferential length at the preselected temperature, they may be different in circumferential length. In such a case, even if the belts 8 and 16 have the same coefficient of friction and are subject to the same heating conditions, the circumferential lengths of the belts 8 and 16 differ from each other in accordance with the temperature. However, for an image of standard size A4, if the difference in circumferential length between the belts 8 and 16 during image formation is 5 mm or below, preferably 3 mm or below, the difference may safely be considered to lie in an allowable range. In this condition, the difference in position between the leading edges of images formed on opposite surfaces of the sheet P is acceptable in practice.

A first modification of the illustrative embodiment will be described hereinafter with reference to FIG. 15. Because the first modification is identical with the illustrative embodiment as to the electrophotographic process and other basic arrangements, the following description will concentrate on differences between the modification and the illustrative embodiment.

Figure 15:
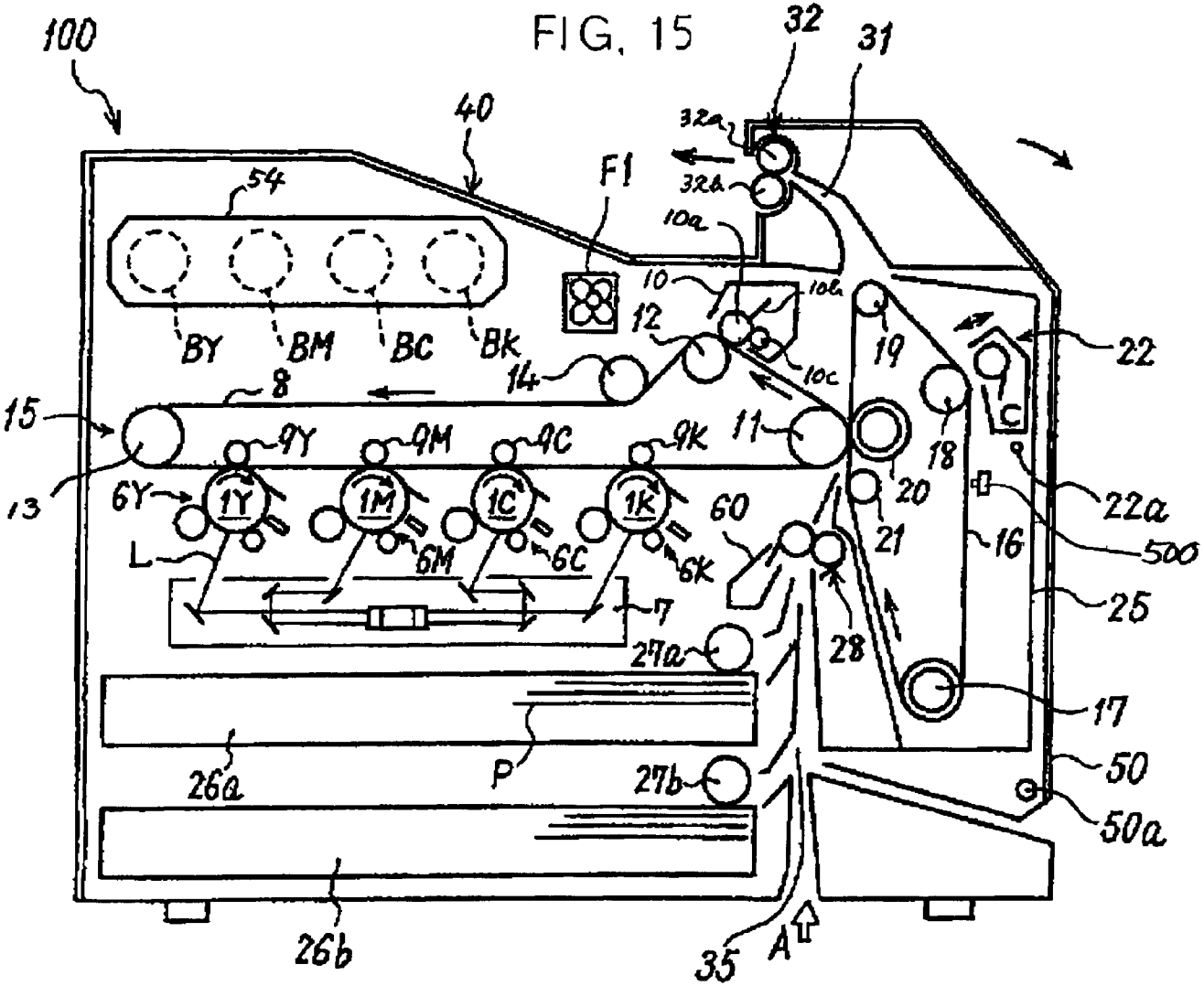
FIG. 15 is a view showing a first modification of the alternative embodiment.

As shown in FIG. 15, the first modification additionally includes a mark sensor or mark sensing means 500 responsive to a mark toner image formed on the second belt 16. The mark sensor 500, implemented by an optical sensor by way of example, is positioned downstream of the second belt cleaner 22 in the direction of belt movement. On sensing the mark toner image, the mark sensor 500 sends a sense signal to a controller or latent image forming timing control means 600, see FIG. 16, which will be described later. In response, the controller 600 sees the position of the leading edge of a toner image present on the belt 16.

Figure 16:
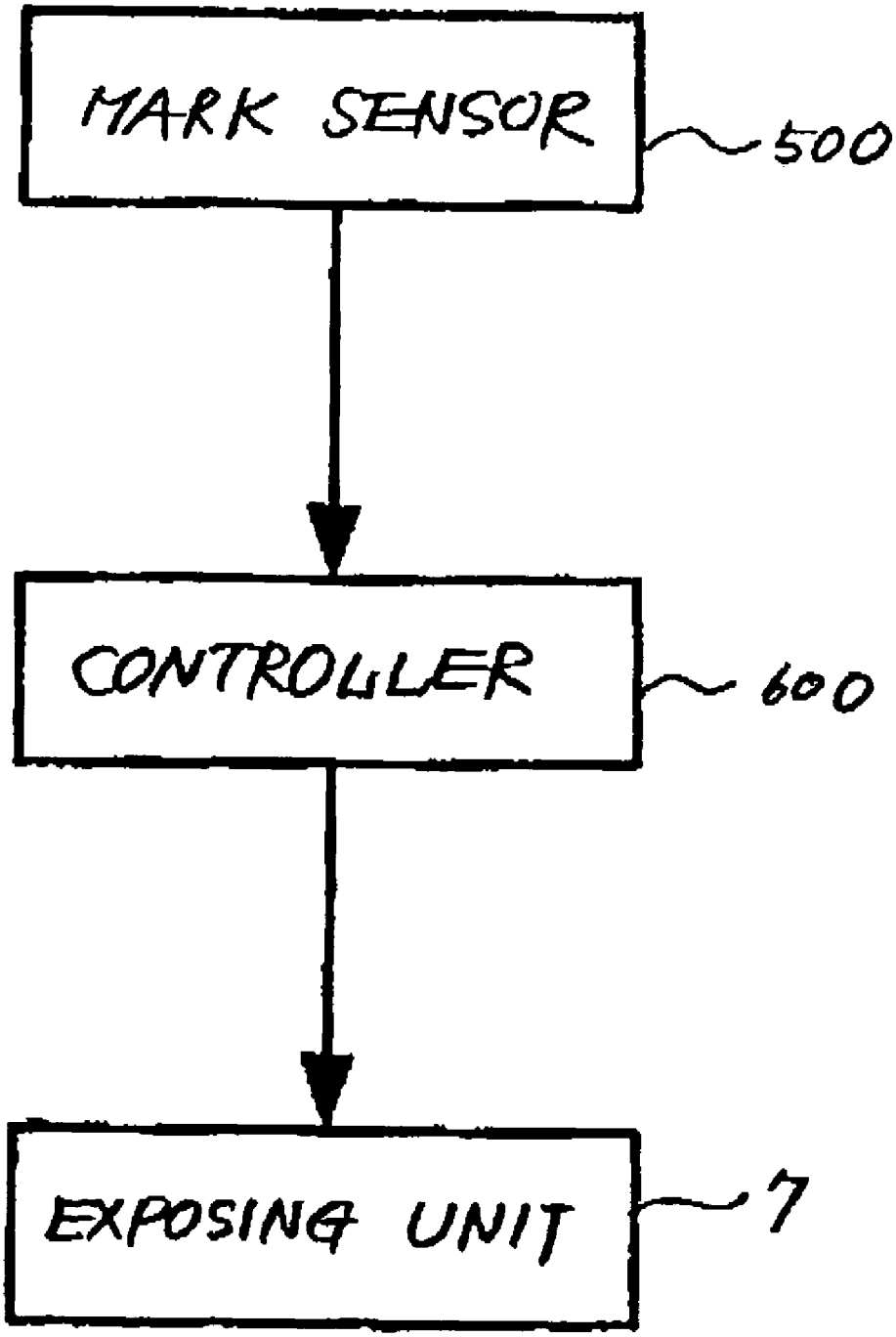
FIG. 16 is a schematic block diagram showing a control system included in the first modification.

FIG. 16 schematically shows a control system including the controller 600 configured to control the exposure timing of the exposing unit 7. As shown, the controller 600 is connected to the mark sensor 500 and receives the sense signal mentioned above. Further, the controller 600 is connected to the exposing unit 7 in order to control exposure timing relating to the second toner image in accordance with the sense signal.

Figure 17:
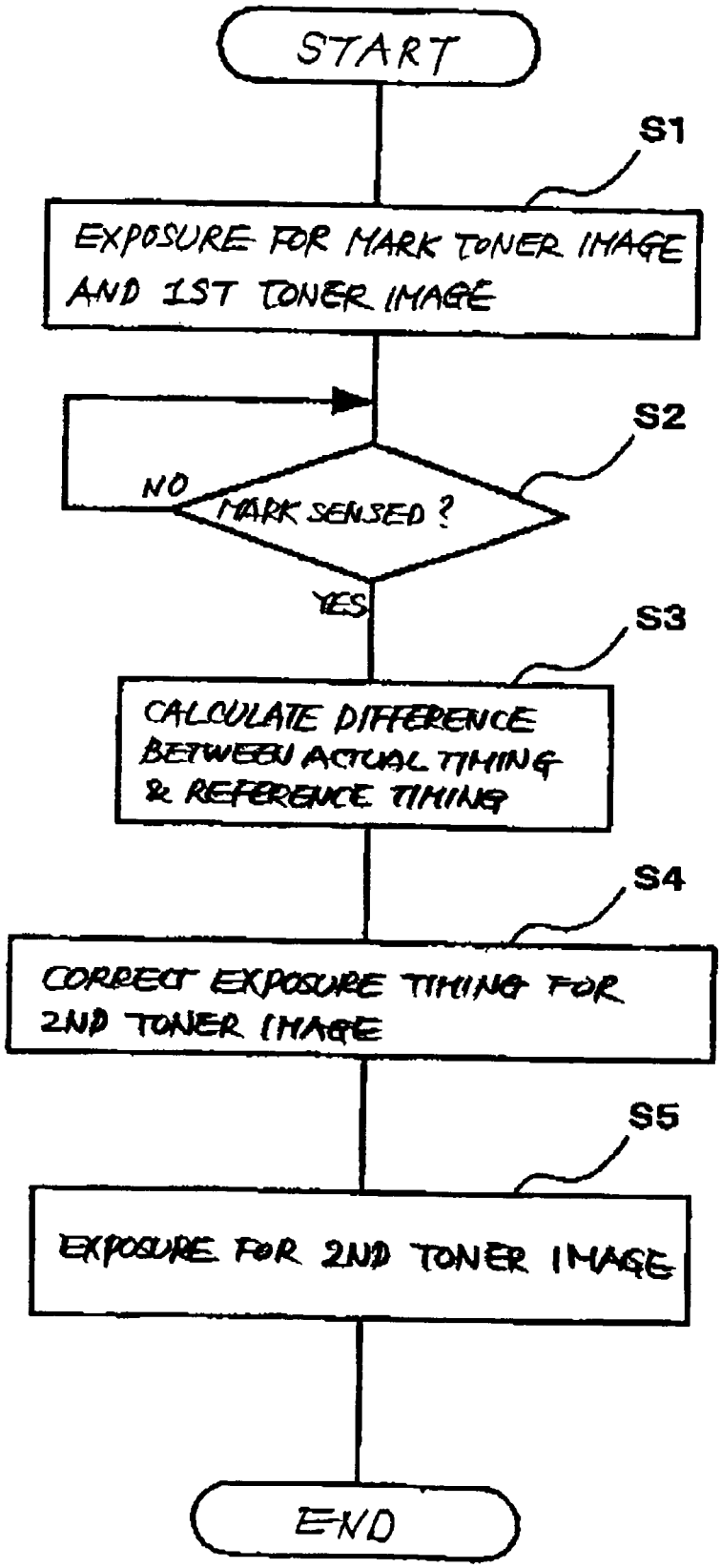
FIG. 17 is a flowchart demonstrating a specific operation of the first modification.

FIG. 17 demonstrates control effected by the controller 600 over the exposing unit 7. As shown, in the duplex print mode, the controller 600 executes exposure processing for forming latent images on the drums 1Y through 1K (step S1). In the step S1, in response to a command received from the controller 600, the exposing unit 7 forms a latent image representative of the mark toner image together with the above latent images. More specifically, the latent image is formed only on the drum 1K such that the mark toner image adjoins the leading edge of the first toner image on the first belt 8 in the widthwise direction of the belt. This latent image is therefore formed in black. The latent image is positioned on the first belt 8 outside of the image forming range in the widthwise direction of the belt.

Subsequently, the first toner image and mark toner image are transferred from the first belt 8 to the second belt 16. On sensing the mark toner image on the second belt 16 (YES, step S2), the mark sensor 500 sends a sense signal to the controller 600. The controller 600 compares the mark signal receipt timing and a reference receipt timing to thereby produce a difference (step S3). The reference receipt timing may be a timing at which the controller 600 receives the sense signal when the circumferential length of the second belt 16 is one that holds at average temperature during image formation. The difference produced in the step S3 can be regarded as a difference between the circumferential length of the belt 16 during image formation and that of the belt 16 at the average temperature.

The exposure timing of the exposing unit 7 for forming latent images expected to constitute the second toner image is selected on the basis of the circumferential length of the second belt 16 at the average temperature. More specifically, the exposure timing for the second toner image is selected such that the leading edge of the second toner image on the first belt 8 arrives at the second image transfer nip at the same time as the leading edge of the first toner image on the second belt 16 arrives at the above nip when the belt 16 has the above circumferential length. Therefore, if the temperature of the second belt 18 during image formation differs from the average temperature, then the circumferential length of the belt 16 during image formation differs from the circumferential length at the average temperature due to thermal expansion. As a result, the timing at which the first toner image on the belt 16 arrives at the secondary image transfer nip is shifted.

To solve the above problem, the controller 600 corrects the timing for forming the latent images expected to constitute the second toner image in accordance with the difference produced in the step S3 (step S4). More specifically, the controller 600 determines, based on the difference, a shift of the timing at which the first toner image on the belt 16 arrives at the secondary image transfer nip. The controller 600 then delays or advances the exposure timing for the above latent images by a period of time corresponding to the shift thus determined.

For example, it the temperature of the belt 16 during image formation is higher than the average temperature, then the circumferential length of the belt 16 increases due to thermal expansion and delays the timing at which the first toner image on the belt 16 reaches the secondary image transfer nip. It is therefore necessary to delay the exposure timing for the second toner image relative to the timing expected at the average temperature, so that the first and second toner images can arrive at the above nip at the same time. The delay of the timing can be calculated on the basis of the sense signal receipt timing.

After the correction described above, the controller 600 causes the exposing unit 4 to perform exposure for forming the latent images expected to form the second toner image on the drums 1Y through 1K (step S5). Consequently, the leading edge of the first toner image successfully arrives at the secondary image transfer nip at the same time as the leading edge of the second toner image. In this manner, the leading edges of the toner images formed on both surfaces of the sheet P are shifted little from each other.

A second modification of the illustrative embodiment will be described hereinafter. Because the second modification is identical with the illustrative embodiment as to the electrophotographic process and other basic arrangements, the following description will concentrate on differences between the modification and the illustrative embodiment.

Figure 18:
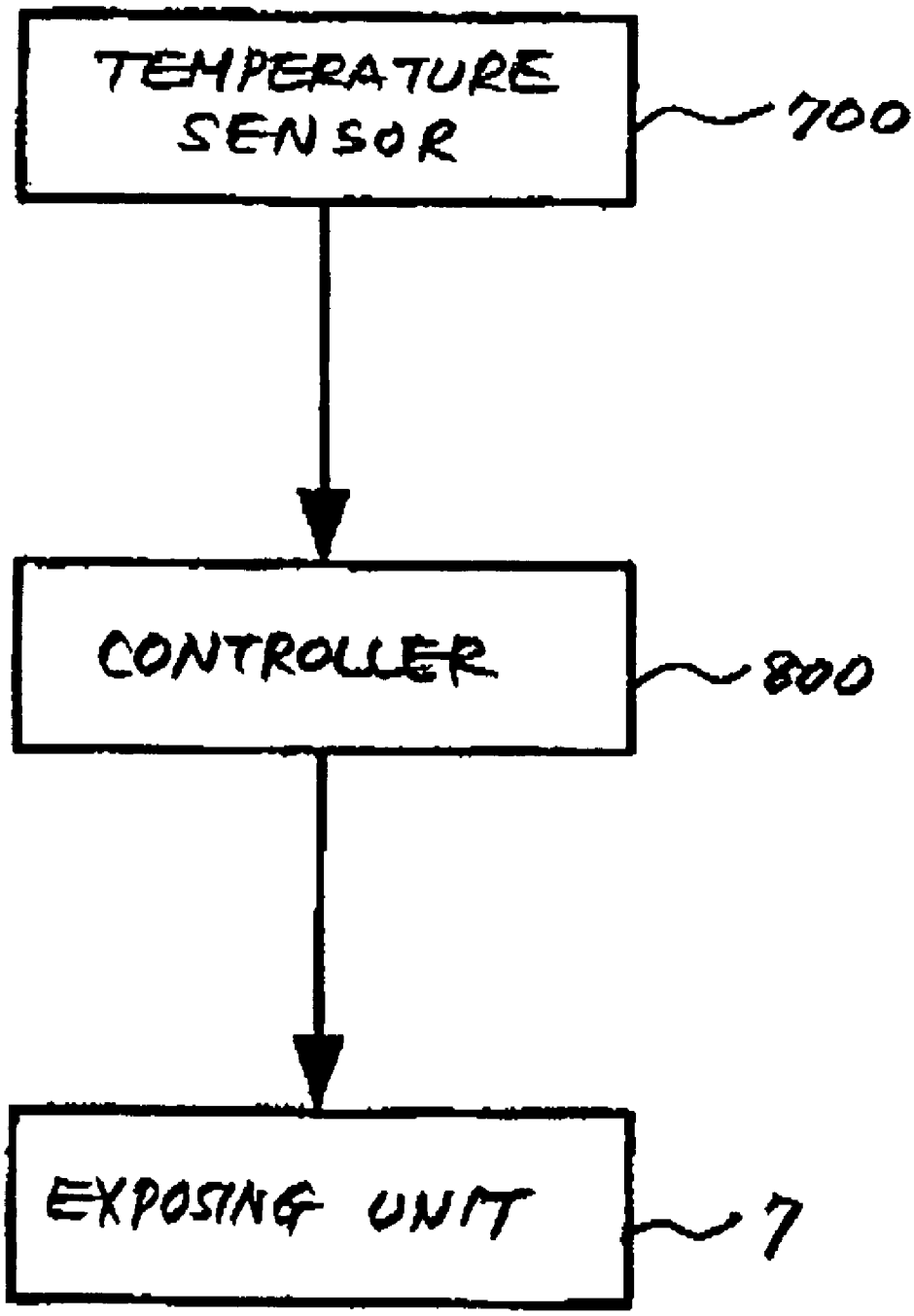
FIG. 18 is a schematic block diagram showing a control system representative of a second modification of the alternative embodiment.

The second modification additionally includes a temperature sensor or temperature sensing means 700, see FIG. 18, responsive to the temperature of the second belt 16 in place of the mark sensor 500. The temperature sensor 700 is located at the same position as the mark sensor 500. The temperature sensor 700 continuously sends its output to a controller or latent image forming timing control means 800, see FIG. 18, which will be described later. The controller 800 can therefore see the temperature of part of the second belt 16 passing the temperature sensor 700.

FIG. 18 schematically shows a control system including the controller 800 configured to control the exposure timing of the exposing unit 7. As shown, the controller 700 is connected to the temperature sensor 700 and receives the output signal of the sensor 700. Further, the controller 800 is connected to the exposing unit 7 in order to control exposure timing relating to the second toner image in accordance with the output signal of the temperature sensor 700.

Figure 19:
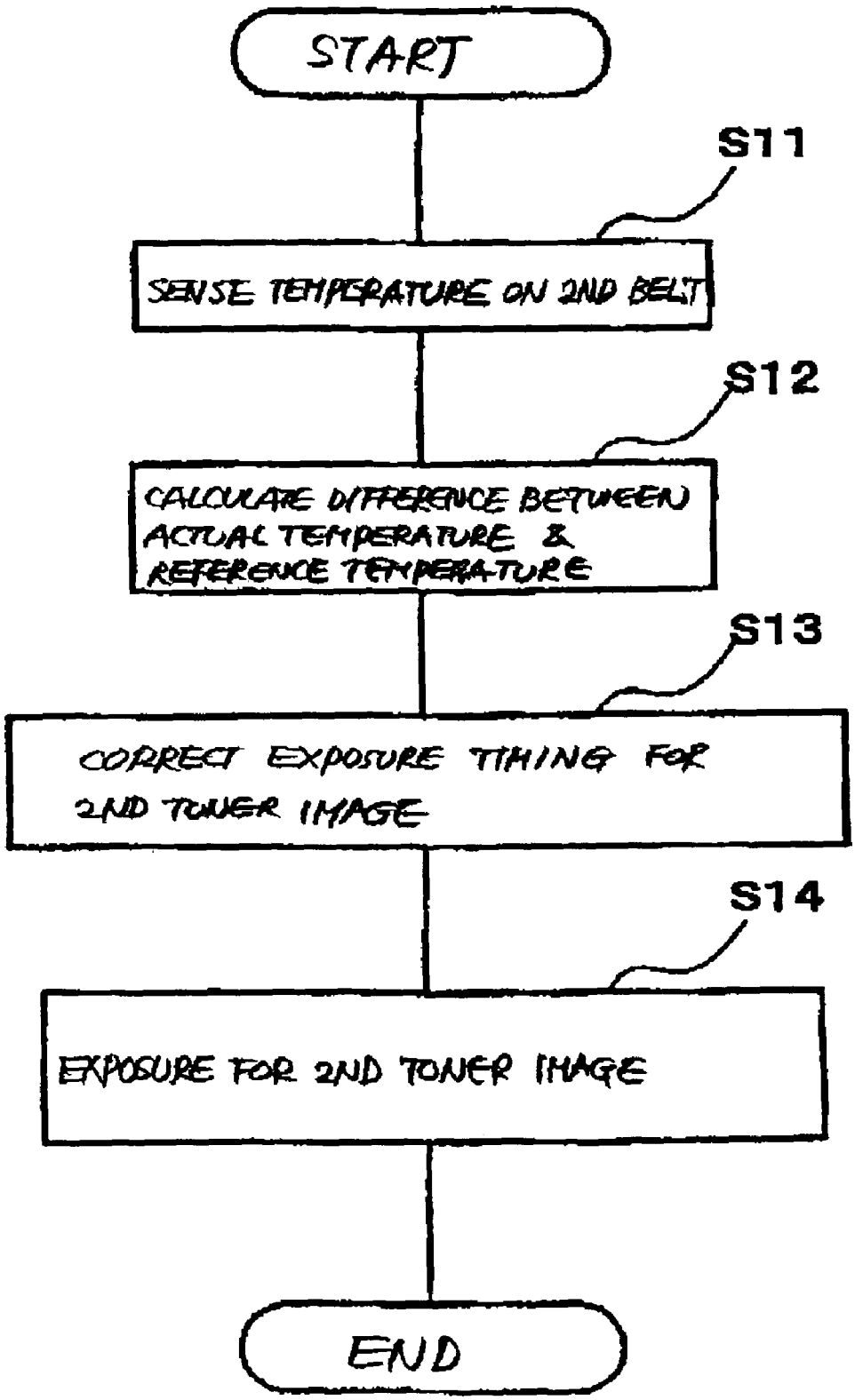
FIG. 19 is a flowchart demonstrating a specific operation of the second modification.

FIG. 19 demonstrates control executed by the controller 800 over the exposure timing. As shown, before the latent images expected to constitute the second toner image are formed, the controller 800 determines the temperature of the second belt 16 on the basis of the output signal of the temperature sensor 700 (step S11). The controller 800 then compares the temperature represented by the sensor output and a reference temperature to thereby produce a difference (step S12). The reference temperature may be the average temperature during image formation. The above difference allows the controller 800 to calculate an approximate difference between the circumferential length of the second belt 16 during image formation and the circumferential length at the average temperature. More specifically, because the material and circumferential length of the belt 16 are known at the design stage, circumferential lengths at various temperatures are sampled by, e.g., experiments. By referencing data thus sampled, the controller 800 can determine the circumferential length of the belt 16 during image formation.

The exposure timing of the exposing unit 7 for forming latent images expected to constitute the second toner image is selected on the basis of the circumferential length of the belt 16 at the average temperature, as stated earlier. Therefore, if the temperature of the belt 18 during image formation differs from the average temperature, then the circumferential length of the belt 16 during image formation differs from the circumferential length at the average temperature due to thermal expansion. As a result, the timing at which the first toner image on the belt 16 arrives at the secondary image transfer nip is shifted, as stated previously.

To solve the above problem, the controller 800 corrects the timing for forming the latent images expected to constitute the second toner image in accordance with the difference produced in the step S12 (step S13). More specifically, the controller 800 determines, based on the difference, a shift of the timing at which the first toner image on the belt 16 arrives at the secondary image transfer nip. The controller 800 then delays or advances the exposure timing for the above latent images by a period of time corresponding to the shift thus determined in the same manner as in the first modification.

After the correction described above, the controller 800 causes the exposing unit 4 to perform exposure for forming the latent images expected to form the second toner image on the drums 1Y through 1K (step S14). Consequently, the leading edge of the first toner image successfully arrives at the secondary image transfer nip at the same time as the leading edge of the second toner image. In this manner, the leading edges of the toner images formed on both surfaces of the sheet P are shifted little from each other.

The illustrative embodiment is advantageous over the first and second modifications thereof in that it does not have to control exposure timing with the mark sensor 500 or the temperature sensor 700. However, the illustrative embodiment is not practicable unless various conditions are satisfied, e.g., unless the first and second belts 8 and 16 have the same coefficient of thermal expansion and unless the belts 8 and 16 have the same circumferential length and subject to the same heating conditions. By contrast, the first and second modifications are substantially free from such limitations and can control the shift of the leading edges of images formed on opposite surfaces of the sheet P while implementing free construction and layout. This advantage is particularly significant when the materials and path lengths of the belts 8 and 16 should preferably be selected independently of each other in matching relation to the function, role, location and so forth.

For example, when electrostatic image transfer is applied to the consecutive primary image transfer nips, the first belt 8 must be provided with resistance adequate for forming an electric field for image transfer. On the other hand, image transfer at the secondary image transfer nip that uses thermal image transfer and fixation, it is not necessary to take account of the resistance of the second belt 16, In such a case, the first and second belts 8 and 16 each should be formed of a particular adequate material.

Further, if the temperature of the drums 1Y through 1K excessively rises, then toner is apt to adhere to the drums 1Y through 1K and lower image quality. It is therefore necessary to sufficiently cool off part of the first belt 8 heated at the secondary image transfer nip before it arrives at the primary image transfer nips. For this purpose, the circumferential length of the first belt 8 is sometimes made greater than the circumferential length of the second belt 16, which does not have to be cooled off. Also, when the drums 1Y through 1K are arranged side by side, as shown in FIG. 1, the first belt 8 must be provided with substantial length. By contrast, the second belt 16, which is free from such a limitation, can originally be made shorter than the first belt 8 for the space saving purpose. The first and second modifications are practicable without equalizing the circumferential lengths of the two belts 8 and 16, so that the second belt 16 can be made short for saving space.

The first modification needs the extra step of forming the mark toner image while the second modification does not need it, but should only sense temperature, and is therefore simpler in control than the first modification. However, the problem with the second modification is that when the thermal expansion characteristic of the second belt 16 varies due to aging, the accuracy of control over the leading edge positions of images formed on opposite surfaces of the sheet P is lowered. By contrast, the first modification, directly sensing the leading edge position of the first toner image, preserves the above accuracy even when the thermal expansion characteristic of the second belt 16 varies.

In the illustrative embodiment, electrostatic image transfer is applied to the image transfer at the consecutive primary image transfer nips, as stated earlier. The first and second belts 8 and 16 each have volumetric resistivity of $10^6$ Ω·cm or above, but $10^{12}$ Ω·cm or below, and surface resistivity of $10^8$ Ω·cm$^2$ or above, but $10^{14}$ Ω·cm$^2$ or below, as also stated previously. This allows electric fields for image transfer to be formed at the primary image transfer nips. To provide the second belt 16 with a coefficient of thermal expansion comparable with that of the first belt 8, the belt 16 should also preferably be provided volumetric resistivity or surface resistivity comparable with one stated above. This is because to implement the volume resistivity or surface resistivity stated above a resistance control agent is added to the belt in order to control the resistance, but the resistance control agent usually causes the coefficient of thermal expansion of the belt to vary. It follows that although the second belt 16 originally does not have to be provided with such volume resistivity or surface resistivity, the second belt 16 is provided with volume resistivity or surface resistivity comparable with that of the first belt 8 so as to have substantially the same coefficient of thermal expansion as the first belt 8.

The resistance control agent mentioned above is implemented as an electron conduction type of conduction agent. This type of conduction agent has resistance that varies little and has high thermal conductivity, compared to an ion agent, polar group or similar resistance control agent. Therefore, in a printer of the type effecting thermal image transfer like the illustrative embodiment, it is possible to stabilize resistance and to insure adequate heat transfer to toner images on the belts 8 and 16, thereby enhancing image quality.

As stated above, in the event of simultaneous thermal transfer of toner images from the first and second belts 8 and 16 to opposite surfaces of the sheet P, the illustrative embodiment and modifications thereof can sufficiently control, even when the path lengths of the belts 8 and 16 vary due to thermal expansion, the resulting difference between the path lengths. It is therefore possible to reduce a difference in position between the leading edges of the toner images transferred to the opposite surfaces of the sheet P.

Various modifications will become possible for those skilled in the art after receiving the teachings of the present disclosure without departing from the scope thereof.

What is claimed is:

1. In a method of transferring toner images to opposite surfaces of a single recording medium and fixing said toner images, an image transferring and fixing step comprising the steps of:

heating with heating means a contact position where a first belt and a second belt, endlessly moving in a same direction at least at a position where said first belt and second belt face each other, contact each other;

transferring a first toner image from an image carrier to said first belt and heating said first toner image at the contact position to thereby transfer said first toner image to said second belt;

transferring a second toner image from said image carrier to said first belt; and heating, at the contact position, the first toner image carried on said second belt to thereby transfer said first toner image to a first surface of the recording medium and fix said first toner image and, at the same time, heating the second toner image carried on said first belt to thereby transfer said second toner image to a second surface of said recording medium and fix said second toner image;

wherein a heating temperature of said heating means is higher than a melting point or a softening point of an image forming agent, which forms the first toner image and the second toner image, by 10° C. to 30° C., and a heating range over which said heating means heats the contact position, as measured in a direction of belt length, is so sized as to implement transfer and fixation of the first toner image and the second toner image to the recording medium at said heating temperature.

2. In an image forming method comprising the steps of forming a first toner image on an image carrier, forming a second toner image on said image carrier, and executing simultaneous image transfer and fixation that transfers said first toner image to a first surface of a recording medium and fixes said first toner image and, at the same time, transfers said second toner image to a second surface of said recording medium and fixes said second toner image, said simultaneous image transfer and fixation comprising the steps of:

heating with heating means a contact position where a first belt and a second belt, endlessly moving in a same direction at least at a position where said first belt and second belt face each other, contact each other;

transferring the first toner image from the image carrier to said first belt and heating said first toner image at the contact position to thereby transfer said first toner image to said second belt;

transferring the second toner image from the image carrier to said first belt; and heating, at the contact position, the first toner image carried on said second belt to thereby transfer said first toner image to the first surface of the recording medium and fix said first toner image and, at the same time, heating the second toner image carried on said first belt to thereby transfer said second toner image to the second surface of said recording medium and fix said second toner image;

wherein a heating temperature of said heating means is higher than a melting point or a softening point of an image forming agent, which forms the first toner image and the second toner image, by 10° C. to 30° C., and a heating range over which said heating means heats the contact position, as measured in a direction of belt length, is so sized as to implement transfer and fixation of the first toner image and the second toner image to the recording medium at said heating temperature.

3. An image forming apparatus for forming toner images on both sides of a single recording medium, said image forming apparatus comprising:

an agent storing section storing an image forming agent;

toner image forming means for forming a toner image on an image carrier by using the image forming agent;

a first belt and a second belt contacting each other while endlessly moving in a same direction at least at a position where said first belt and said second belt face each other;

a first heating member configured to heat the contact position from an inside surface of said first belt; and a second heating member configured to heat the contact position from an inside surface of said second belt, wherein after a first toner image formed on said image carrier has been transferred to said first belt and heated at the contact position to be thereby transferred to said second belt and a second toner image formed on said image carrier has been transferred to said first belt, said first toner image on said second belt is heated, at said contact position, to be thereby transferred to a first surface of the recording medium and fixed while, at the same time, said second toner image on said first belt is heated to be thereby transferred to a second surface of said recording medium and fixed, a heating temperature of said heating means is higher than a melting point or a softening point of the image forming agent, which forms the first toner image and the second toner image, by 5° C. to 50° C., a heating range over which said heating means heats the contact position, as measured in a direction of belt length, is so sized as to implement transfer and fixation of the first toner image and the second toner image to the recording medium at said heating temperature, and the recording medium passes through the heating range in 0.05 second or above.

4. The apparatus as claimed in claim 3, wherein the recording medium passes through the heating range in 1.00 second or below.

5. The apparatus as claimed in claim 3, wherein the image forming agent, heated at the contact position to the melting point or the softening point or above, is cooled off below said melting point or said softening point at said contact position.

6. The apparatus as claimed in claim 5, wherein the contact position is cooled off in a cooling range downstream of the heating range in a direction of belt movement.

7. The apparatus as claimed in claim 6, wherein said first heating member and said second heating member respectively comprise a support member over which said first belt is passed and a support member over which said second belt is passed, and part of said first belt, extending from said first heating member to a support member downstream of said first heating member in the direction of belt movement, and part of said second belt, extending from said second heating member to a support member downstream of said second heating member in said direction of belt movement, contact each other.

8. The apparatus as claimed in claim 5, wherein the image forming agent, heated in the heating range, softens to a viscosity of $10^6$ Pa or below.

9. The apparatus as claimed in claim 8, wherein the image forming agent, heated in the heating range, softens to a viscosity of $10^5$ Pa or above.

10. The apparatus as claimed in claim 3, wherein said first belt and said second belt each are 1 $\mu$m to 400 $\mu$m thick.

11. The apparatus as claimed in claim 3, further comprising first belt cooling means for cooling part of said first belt moved away from the contact position, but not reached a position where said first belt faces said image carrier.

12. The apparatus as claimed in claim 11, wherein said first belt cooling means comprises a heat pipe.

13. The apparatus as claimed in claim 11, further comprising first cleaning means for cleaning part of said first belt moved away from the contact position, but not reached said first belt cooling means.

14. The apparatus as claimed in claim 3, further comprising a peeler configured to peel off the recording medium from said first belt or said second belt at a position downstream of the contact position in a direction of belt movement.

15. The apparatus as claimed in claim 14, wherein said peeler is spaced from said first belt or said second belt by a clearance of 0.01 mm to 5 mm.

16. The apparatus as claimed in claim 3, wherein said image carrier comprises a plurality of image earners arranged such that toner images formed on said plurality of image carriers are sequentially transferred to said first belt one above the other.

17. An image forming apparatus for forming toner images on both sides of a single recording medium, said image forming apparatus comprising:

toner image forming means for forming a toner image on an image carrier by using an image forming agent;

a first belt and a second belt contacting each other while endlessly moving in a same direction at least at a position where said first belt and said second belt face each other;

a first heating member configured to heat the contact position from an inside surface of said first belt; and a second heating member configured to heat the contact position from an inside surface of said second belt, wherein after a first toner image formed on said image carrier has been transferred to said first belt and heated at the contact position to be thereby transferred to said second belt and a second toner image formed on said image carrier has been transferred to said first belt, said first image on said second belt is heated, at said contact position, to be thereby transferred to a first surface of the recording medium and fixed while, at the same time, said second toner image on said first belt is heated to be thereby transferred to a second surface of said recording medium and fixed, the image forming agent comprises a specified image forming agent, a heating temperature of said heating means is higher than a melting point or a softening point of the image forming agent, which forms the first toner image and the second toner image, by 5° C. to 50° C., a heating range over which said heating means heats the contact position, as measured in a direction of belt length, is so sized as to implement transfer and fixation of the first toner image and the second toner image, and the recording medium passes through the heating range in 0.05 second or above.

18. The apparatus as claimed in claim 17, wherein the recording medium passes through the heating range in 1.00 second or below.

19. The apparatus as claimed in claim 17, wherein the image forming agent, heated at the contact position to the melting point or the softening point or above, is cooled off below said melting point or said softening point at said contact position.

20. The apparatus as claimed in claim 19, wherein the contact position is cooled off in a cooling range downstream of the heating range in a direction of belt movement.

21. The apparatus as claimed in claim 20, wherein said first heating member and said second heating member respectively comprise a support member over which said first belt is passed and a support member over which said second belt is passed, and part of said first belt, extending from said first heating member to a support member downstream of said first heating member in the direction of belt movement, and part of said second belt, extending from said second heating member to a support member downstream of said second heating member in said direction of belt movement, contact each other.

22. The apparatus as claimed in claim 19, wherein the image forming agent, heated in the heating range, softens to a viscosity of $10^6$ Pa or below.

23. The apparatus as claimed in claim 22, wherein the image forming agent, heated in the heating range, softens to a viscosity of $10^5$ Pa or above.

24. The apparatus as claimed in claim 17, wherein said first belt and said second belt each are 1 μm to 400 μm thick.

25. The apparatus as claimed in claim 17, further comprising first belt cooling means for cooling part of said first belt moved away from the contact position, but not reached a position where said first belt faces said image carrier.

26. The apparatus as claimed in claim 25, wherein said first belt cooling means comprises a heat pipe.

27. The apparatus as claimed in claim 25, further comprising first cleaning means for cleaning part of said first belt moved away from the contact position, but not reached said first belt cooling means.

28. The apparatus as claimed in claim 17, further comprising a peeler configured to peel off the recording medium from said first belt or said second belt at a position downstream of the contact position in a direction of belt movement.

29. The apparatus as claimed in claim 28, wherein said peeler is spaced from said first belt or said second belt by a clearance of 0.01 mm to 5 mm.

30. The apparatus as claimed in claim 17, wherein said image carrier comprises a plurality of image carriers arranged such that toner images formed on said plurality of image carriers are sequentially transferred to said first belt one above the other.

31. An image forming system comprising:

an image forming apparatus for forming toner images on both sides of a single recording medium; and a computer configured to send control signals to said image forming apparatus;

said image forming apparatus comprising:

an agent storing section storing an image forming agent;

toner image forming means for forming a toner image on an image carrier by using the image forming agent;

a first belt and a second belt contacting each other while endlessly moving in a same direction at least at a position where said first belt and said second belt face each other; and heating means for heating a contact position where said first belt and said second belt contact each other;

wherein after a first toner image formed on said image carrier has been transferred to said first belt and heated at the contact position to be thereby transferred to said second belt and a second toner image formed on said image carrier has been transferred to said first belt, said first image on said second belt is heated, at said contact position, to be thereby transferred to a first surface of the recording medium and fixed while, at the same time, said second toner image on said first belt is heated to be thereby transferred to a second surface of said recording medium and fixed, a heating temperature of said heating means is higher than a melting point or a softening point of the image forming agent, which forms the first toner image and the second toner image, by 10° C. to 30° C., and a heating range over which said heating means heats the contact position, as measured in a direction of belt length, is so sized as to implement transfer and fixation of the first toner image and the second toner image to the recording medium at said heating temperature.

32. An image forming system comprising:

an image forming apparatus for forming toner images on both sides of a single recording medium; and a computer configured to send control signals to said image forming apparatus;

said image forming apparatus comprising:

toner image forming means for forming a toner image on an image carrier by using an image forming agent;

a first belt and a second belt contacting each other while endlessly moving in a same direction at least at a position where said first belt and said second belt face each other; and heating means for heating a contact position where said first belt and said second belt contact each other;

wherein after a first toner image formed on said image carrier has been transferred to said first belt and heated at the contact position to be thereby transferred to said second belt and a second toner image formed on said image carrier has been transferred to said first belt, said first image on said second belt is heated, at said contact position, to be thereby transferred to a first surface of the recording medium and fixed while, at the same time, said second toner image on said first belt is heated to be thereby transferred to a second surface of said recording medium and fixed, the image forming agent comprises a specified image forming agent, a heating temperature of said heating means is higher than a melting point or a softening point of the image forming agent, which forms the first toner image and the second toner image, by 10° C. to 30° C., and a heating range over which said heating means heats the contact position, as measured in a direction of belt length, is so sized as to implement transfer and fixation of the first toner image and the second toner image.

33. In a thermal image transferring device comprising a first image carrier and a second image carrier, endlessly moving while carrying a toner image each, for transferring a first toner image formed on said first image carrier to said second image carrier and heating a second toner image newly formed on said first image carrier and said first toner image transferred to said second image carrier to thereby transfer said first toner image and said second toner image to opposite surfaces of a single recording medium, a coefficient of thermal expansion of said first image carrier and a coefficient of thermal expansion of said second image carrier are selected such that a difference between a path length of said first image carrier and a path length of said second image carrier varies within an allowable range within a possible temperature range of said first image carrier and said second image carrier.

34. The device as claimed in claim 33, wherein a contact position where said first image carrier and said second carrier contact each other is heated to thereby transfer the first toner image and the second toner image to the opposite surfaces of the recording medium.

35. The device as claimed in claim 34, wherein said first image carrier and said second image carrier are configured such that said first image carrier and said second image carrier have a same path length at a preselected temperature and have a same coefficient of thermal expansion within the possible temperature range, and said first image carrier and said second image carrier are subject to a same heating condition.

36. The device as claimed in claim 35, wherein said first image carrier and said second image carrier are provided with single layer structures formed of a same material.

37. The device as claimed in claim 35, wherein said first image carrier and said second image carrier have laminate structures including bases formed of a same material.

38. The device as claimed in claim 37, wherein said first image carrier and said second image carrier comprise hollow, endless movable members having a same thickness, which is between 30 $\mu$m and 500 $\mu$m.

39. The device as claimed in claim 38, wherein the bases each are two times or more as thick as a layer formed on the base.

40. The device as claimed in claim 37, wherein the bases each are formed of a material containing an imide group, and a surface layer formed on the base is formed of either one of silicone rubber and fluorocarbon resin.

41. The device as claimed in claim 35, further comprising cooling means for respectively cooling off, on paths respectively assigned to said first image carrier and said second image carrier, part of said first image carrier and part of said second image carrier heated at the contact position, wherein said cooling means are located on said paths such that a temperature of said first image carrier and a temperature of said second image carrier vary in a same manner as each other.

42. The device as claimed in claim 33, wherein said first image carrier and said second image carrier are configured such that said first image carrier and said second image carrier have a same path length at a preselected temperature and have a same coefficient of thermal expansion within the possible temperature range, and said first image carrier and said second image carrier are subject to a same heating condition.

43. The device as claimed in claim 42, wherein said first image carrier and said second image carrier are provided with single layer structures formed of a same material.

44. The device as claimed in claim 42, wherein said first image carrier and said second image carrier have laminate structures including bases formed of a same material.

45. The device as claimed in claim 44, wherein said first image carrier and said second image carrier comprise hollow, endless movable members having a same thickness, which is between 30 $\mu$m and 500 $\mu$m.

46. The device as claimed in claim 45, wherein the bases each are two times or more as thick as a layer formed on the base.

47. The device as claimed in claim 44, wherein the bases each are formed of a material containing an imide group, and a surface layer formed on the base is formed of either one of silicone rubber and fluorocarbon resin.

48. The device as claimed in claim 42, further comprising cooling means for respectively cooling off, on paths respectively assigned to said first image carrier and said second image carrier, part of said first image carrier and part of said second image carrier heated at the contact position, wherein said cooling means are located on said paths such that a temperature of said first image carrier and a temperature of said second image carrier vary in a same manner as each other.

49. An image forming apparatus comprising:

a latent image carrier;

latent image forming means for forming a latent image on said latent image carrier;

image transferring means for transferring a toner image, formed by depositing a toner on the latent image, from said image carrier to a first image carrier endlessly moving; and thermal image transferring means for heating, after transferring a first toner image carried on said first image carrier to a second image carrier endlessly moving, a second toner image newly formed on said first image carrier and said first toner image transferred to said second image carrier to thereby transferring said first toner image and said second toner image to opposite surfaces of a single recording medium;

wherein said thermal image transferring means is configured such that a coefficient of thermal expansion of said first image carrier and a coefficient of thermal expansion of said second image carrier are selected such that a difference between a path length of said first image carrier and a path length of said second image carrier varies within an allowable range within a possible temperature range of said first image carrier and said second image carrier.

50. The apparatus as claimed in claim 49, wherein said image transferring means forms an electric field between said latent image carrier and said first image carrier for electrostatically transferring a toner image from said latent image carrier to said first image carrier, and said first image carrier and said second image carrier each have a volumetric resistivity of $10^6$ Ω·cm or above, but $10^{12}$ Ω·cm or below, and a surface resistivity of $10^8$ Ω·cm$^2$ or above, but $10^{14}$ Ω·cm$^2$ or below.

51. The apparatus as claimed in claim 50, wherein a resistance control agent for controlling the volumetric resistivity or the surface resistivity comprises an electron conduction type of conduction agent.

52. An image forming apparatus for forming toner images on both sides of a single recording medium, said image forming apparatus comprising:

an agent storing section storing an image forming agent;

toner image forming means for forming a toner image on an image carrier by using the image forming agent;

a first belt and a second belt contacting each other while endlessly moving in a same direction at least at a position where said first belt and said second belt face each other;

heating means for heating a contact position where said first belt and said second belt contact each other;

first belt cooling means for cooling part of said first belt moved away from the contact position, but not reached a position where said first belt faces said image carrier; and first cleaning means for cleaning part of said first belt moved away from the contact position, but not reached said first belt cooling means, wherein after a first toner image formed on said image carrier has been transferred to said first belt and heated at the contact position to be thereby transferred to said second belt and a second toner image formed on said image carrier has been transferred to said first belt, said first toner image on said second belt is heated, at said contact position, to be thereby transferred to a first surface of the recording medium and fixed while, at the same time, said second toner image on said first belt is heated to be thereby transferred to a second surface of said recording medium and fixed, a heating temperature of said heating means is higher than a melting point or a softening point of the image forming agent, which forms the first toner image and the second toner image, by 5° C. to 50° C., and a heating range over which said heating means heats the contact position, as measured in a direction of belt length, is so sized as to implement transfer and fixation of the first toner image and the second toner image to the recording medium at said heating temperature.

53. An image forming apparatus for forming toner images on both sides of a single recording medium, said image forming apparatus comprising:

toner image forming means for forming a toner image on an image carrier by using an image forming agent;

a first belt and a second belt contacting each other while endlessly moving in a same direction at least at a position where said first belt and said second belt face each other;

heating means for heating a contact position where said first belt and said second belt contact each other;

first belt cooling means for cooling part of said first belt moved away from the contact position, but not reached a position where said first belt faces said image carrier; and first cleaning means for cleaning part of said first belt moved away from the contact position, but not reached said first belt cooling means, wherein after a first toner image formed on said image carrier has been transferred to said first belt and heated at the contact position to be thereby transferred to said second belt and a second toner image formed on said image carrier has been transferred to said first belt, said first image on said second belt is heated, at said contact position, to be thereby transferred to a first surface of the recording medium and fixed while, at the same time, said second toner image on said first belt is heated to be thereby transferred to a second surface of said recording medium and fixed, the image forming agent comprises a specified image forming agent, a heating temperature of said heating means is higher than a melting point or a softening point of the image forming agent, which forms the first toner image and the second toner image, by 5° C. to 50° C., and a heating range over which said heating means heats the contact position, as measured in a direction of belt length, is so sized as to implement transfer and fixation of the first toner image and the second toner image.

54. An image forming apparatus for forming toner images on both sides of a single recording medium, said image forming apparatus comprising:

an agent storing section storing an image forming agent;

toner image forming means for forming a toner image on an image carrier by using the image forming agent;

a first belt and a second belt contacting each other while endlessly moving in a same direction at least at a position where said first belt and said second belt face each other; and heating means for heating a contact position where said first belt and said second belt contact each other, wherein after a first toner image formed on said image carrier has been transferred to said first belt and heated at the contact position to be thereby transferred to said second belt and a second toner image formed on said image carrier has been transferred to said first belt, said first toner image on said second belt is heated, at said contact position, to be thereby transferred to a first surface of the recording medium and fixed while, at the same time, said second toner image on said first belt is heated to be thereby transferred to a second surface of said recording medium and fixed, a heating temperature of said heating means is higher than a melting point or a softening point of the image forming agent, which forms the first toner image and the second toner image, by 10° C. to 30° C., and a heating range over which said heating means heats the contact position, as measured in a direction of belt length, is so sized as to implement transfer and fixation of the first toner image and the second toner image to the recording medium at said heating temperature.

55. An image forming apparatus for forming toner images on both sides of a single recording medium, said image forming apparatus comprising:

toner image forming means for forming a toner image on an image carrier by using an image forming agent;

a first belt and a second belt contacting each other while endlessly moving in a same direction at least at a position where said first belt and said second belt face each other; and heating means for heating a contact position where said first belt and said second belt contact each other, wherein after a first toner image formed on said image carrier has been transferred to said first belt and heated at the contact position to be thereby transferred to said second belt and a second toner image formed on said image carrier has been transferred to said first belt, said first image on said second belt is heated, at said contact position, to be thereby transferred to a first surface of the recording medium and fixed while, at the same time, said second toner image on said first belt is heated to be thereby transferred to a second surface of said recording medium and fixed, the image forming agent comprises a specified image forming agent, a heating temperature of said heating means is higher than a melting point or a softening point of the image forming agent, which forms the first toner image and the second toner image, by 10° C. to 30° C., and a heating range over which said heating means heats the contact position, as measured in a direction of belt length, is so sized as to implement transfer and fixation of the first toner image and the second toner image.

* * * * *